US010006224B2

(12) United States Patent
Wehr

(10) Patent No.: US 10,006,224 B2
(45) Date of Patent: Jun. 26, 2018

(54) LOCK CYLINDER

(71) Applicant: ABUS August Bremicker Söhne KG, Wetter-Volmarstein (DE)

(72) Inventor: Michel Wehr, Willingen (DE)

(73) Assignee: ABUS AUGUST BREMICKER SÖHNE KG, Wetter-Volmarstein (DE)

( * ) Notice: Subject to any disclaimer, the term of this patent is extended or adjusted under 35 U.S.C. 154(b) by 208 days.

(21) Appl. No.: 14/977,724

(22) Filed: Dec. 22, 2015

(65) Prior Publication Data

US 2016/0186461 A1 Jun. 30, 2016

(30) Foreign Application Priority Data

Dec. 29, 2014 (DE) ..... 10 2014 119 676

(51) Int. Cl.
*E05B 29/00* (2006.01)
*E05B 21/06* (2006.01)

(52) U.S. Cl.
CPC ..... *E05B 29/0013* (2013.01); *E05B 21/066* (2013.01)

(58) Field of Classification Search
CPC ..... E05B 21/066; E05B 29/0013
USPC ..... 70/366
See application file for complete search history.

(56) References Cited

U.S. PATENT DOCUMENTS 2,613,528 A 10/1952 Salmivuori
3,548,620 A * 12/1970 Genakis ..... E05B 21/06 70/356
4,008,588 A * 2/1977 Miller ..... E05B 21/066 70/366

(Continued)

FOREIGN PATENT DOCUMENTS

DE 20118136 U1 2/2002
DE 202007002699 U1 7/2007

(Continued)

*Primary Examiner* — Suzanne L Barrett
(74) *Attorney, Agent, or Firm* — Harness, Dickey & Pierce, P.L.C.

(57) ABSTRACT

A lock cylinder comprises a cylinder housing, a disk housing rotatably supported about a cylinder axis in the cylinder housing and a plurality of rotatably supported disk tumblers arranged along the cylinder axis in the disk housing, wherein each disk tumbler has a reception opening for a key, a blocking cut-out at the outer periphery for an at least partial reception of a blocking pin aligned in parallel with the cylinder axis and a fixing cut-out provided offset from the blocking cut-out at the outer periphery for an at least partial reception of a core pin aligned in parallel with the cylinder axis. The disk tumblers are rotatable from a starting position with a removed key into an end sorting position by a rotation of the introduced key in the latching direction, in which end sorting position the blocking cut-outs of all the disk tumblers are oriented in alignment with one another, viewed in the direction of the cylinder axis. The fixing cut-outs of all the disk tumblers are oriented in alignment with one another in the end sorting position, viewed in the direction of the cylinder axis. The lock cylinder is adapted such that, on a further rotation of the disk tumblers out of the end sorting position in the unlatching direction, the core pin first engages into the fixing cut-outs and the blocking pin only then engages into the blocking cut-outs.

18 Claims, 9 Drawing Sheets

(56) References Cited

U.S. PATENT DOCUMENTS

Figure 1:
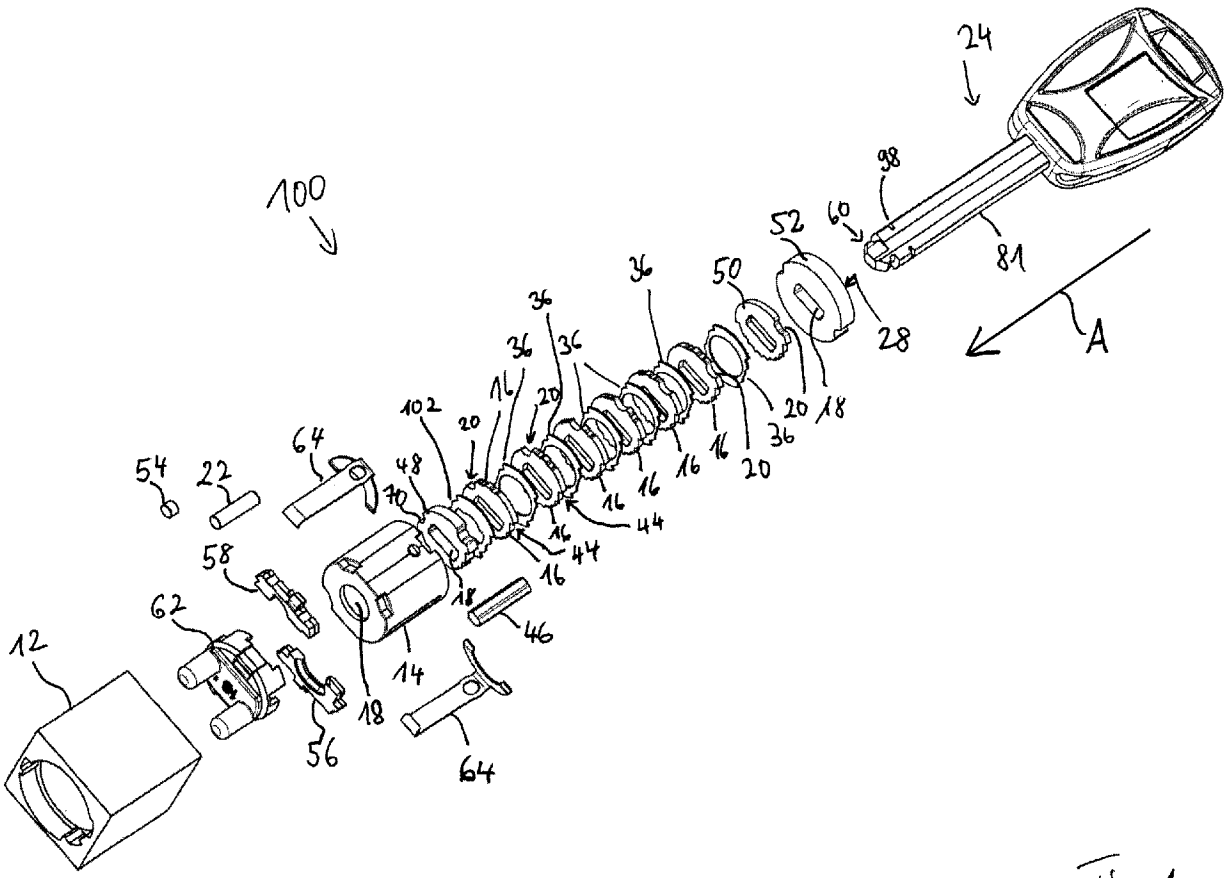

| | | | | |
|---|---|---|---|---|
| 4,195,503 | A | 4/1980 | Roberts | |
| 4,359,886 | A * | 11/1982 | Evans | E05B 21/066 70/366 |
| 4,512,166 | A | 4/1985 | Dunphy et al. | |
| 4,942,749 | A * | 7/1990 | Rabinow | E05B 29/004 70/383 |
| 5,205,143 | A * | 4/1993 | Hakkarainen | E05B 21/066 70/366 |
| 5,388,438 | A * | 2/1995 | Paavo | E05B 21/066 70/366 |
| 5,613,389 | A * | 3/1997 | Hauser | E05B 29/0013 70/366 |
| 6,591,645 | B1 | 7/2003 | Wittwer | |
| 8,656,746 | B2 | 2/2014 | Buhl | |
| 9,234,370 | B2 * | 1/2016 | Dolev | E05B 9/042 |
| 2003/0051521 | A1 * | 3/2003 | Mielonen | E05B 21/066 70/365 |
| 2010/0212382 | A1 * | 8/2010 | Martikainen | E05B 19/0017 70/377 |
| 2014/0041427 | A1 | 2/2014 | Zuraski et al. | |
| 2014/0373581 | A1 * | 12/2014 | Uljens | E05B 29/0013 70/357 |
| 2015/0300044 | A1 * | 10/2015 | Malinen | E05B 21/066 70/353 |

FOREIGN PATENT DOCUMENTS

| | | | |
|---|---|---|---|
| EP | 0712979 | A1 | 5/1996 |
| EP | 0978608 | A1 | 2/2000 |
| GB | 1414205 | A | 11/1975 |

* cited by examiner

LOCK CYLINDER

The present invention relates to a lock cylinder having a cylinder housing, a disk housing rotatably supported about a cylinder axis in the cylinder housing and a plurality of rotatably supported disk tumblers arranged along the cylinder axis in the disk housing, wherein each disk tumbler has a reception opening for a key, a blocking cut-out at the outer periphery for an at least partial reception of a blocking pin aligned in parallel with the cylinder axis and a fixing cut-out provided offset from the blocking cut-outs at the outer periphery for an at least partial reception of a core pin aligned in parallel with the cylinder axis, wherein the disk tumblers are rotatable from a starting position with a removed key into an end sorting position by a rotation of the introduced key in the unlatching direction, in which end sorting position the blocking cut-outs of all the disk tumblers are oriented in alignment with one another, viewed in the direction of the cylinder axis.

A lock cylinder having rotatable disk tumblers is also called a disk cylinder. Such a lock cylinder is disclosed in DE 10 2011 015 314 A1. A disk cylinder is also known from EP 0 712 979 B1.

In accordance with FIGS. 25 and 26, a lock cylinder 10 can have a cylinder housing 12 and a cylinder core which is rotatably supported about a cylinder axis in the cylinder housing 12 and which is also called a disk housing 14 in the following. The rotational movement of the cylinder core or of the disk housing 14 can be transferred via a coupling section 30 connected to the disk housing 14 to a latching mechanism of a lock, not shown, and the lock can thus be unlatched or latched using the lock cylinder 10.

A plurality of rotatable disk tumblers 16, which are also called locking disks or tumbler disks, are received one after the other along the cylinder axis in the disk housing 14. The disk tumblers 16 have respective central reception openings 18 which together form a keyway 28 for introducing a key 24 and which have a rectangular cross-section in the example shown. The disk tumblers 16 furthermore have respective peripheral cut-outs in the form of blocking cut-outs 20 for receiving a blocking pin 22 which is aligned in parallel with the cylinder axis.

The blocking pin 22 is radially movably received in a slit 32 provided in the wall of the disk housing 14. When the lock cylinder 10 is in its closed position and the disk tumblers 16 are thus rotated into their latched position, the blocking pin 22 adopts a radially outer blocking position. In this blocking position, a part section of the blocking pin 22 engages into a blocking pin reception recess 34 provided at the inner wall of the cylinder housing 12 so that the disk housing 14 is blocked (apart from a slight rotational clearance) against a rotational movement relative to the cylinder housing 12.

The disk tumblers 16 can be moved from their latched position into an unlatched position by means of the key 24. When all the disk tumblers 16 are in a so-called end sorting position which lies between the latched position and the unlatched position, the blocking cut-outs 20 of all the disk tumblers 16 are oriented in alignment with one another and radial to the blocking pin 22, viewed in the direction of the cylinder axis.

In the lock cylinder 10 known from the prior art, the blocking pin 22 can then move radially inwardly into its release position in which it is located outside the blocking pin reception recess 34. The disk housing 14 is thereby released for a rotational movement relative to the cylinder housing 12 and the disk housing 14 can be rotated further in the unlatching direction together with the disk tumblers 16 until the unlatched position is reached.

A fixing cut-out 44 for receiving a core pin 46 is furthermore provided at the outer periphery of each disk tumbler 16. The core pin 46 is aligned in parallel with the cylinder axis and is radially movably received in a slit provided in the wall of the disk housing 14. In the closed position of the lock cylinder 10, the core pin 46 engages into the fixing cut-outs 44 of the disk tumblers 16 and thus prevents a rotation of the disk tumblers 16 with respect to one another when no key 24 is introduced.

The key 24 associated with the lock cylinder 10 has a plurality of differently angled incisions 26 which correspond to different angular positions of the blocking cut-outs 20 of the disk tumblers 16. After the introduction into the keyway 28, the key 24 first adopts a so-called initial position from where the key 24 can be rotated in the unlatching direction. By a rotation of the key 24 out of the initial position in the unlatching direction, the key 24 first moves into a so-called zero position in which the core pin 46 can move out of engagement with the fixing cut-outs 44 of the disk tumblers 16 and the disk tumblers 16 are thus released for a rotational movement relative to the disk housing 14 to be able to bring the blocking cut-outs 20 of the disk tumblers 16 into alignment one after the other (so-called sorting, i.e. rotating the disk tumblers 16 into an alignment of their blocking cut-outs 20 with one another).

The disk tumblers 16 have a specific rotational clearance with respect to the respective associated incision 26 of the key 24 whose dimension depends on the angular dimension of the respective incision 26. I.e. in dependence on the angular dimension of the incisions 26, control sections of the respective incisions 26 and corresponding control sections of the central reception openings 18 of the associated respective disk tumblers 16 come into engagement with one another at different points in time or at different angular positions during sorting.

For example, starting from the zero position of the disk tumblers 16, the total rotational path of the key up to the reaching of the end sorting position of all the disk tumblers 16 amounts to approximately 110 degrees, i.e. after a rotation of the key 24 by approximately 110 degrees, all the disk tumblers 16 are sorted and the blocking cut-outs 20 are oriented in radial alignment with the blocking pin 22. A pattern of six different angular positions at uniform intervals is typically provided for the possible angular positions of the blocking cut-outs 20, with the angular spacing between two blocking cut-outs 20 adjacent in the pattern amounting to approximately 18 degrees. Correspondingly, there are six possible encodings for each disk tumbler 16, with the respective disk tumbler 16 having to be rotated by a specific angle out of its zero position for setting one of these encodings. In the exemplary lock cylinder 10, an encoding "1" corresponds to a rotation of the disk tumbler 16 by approximately 20 degrees, an adjacent encoding "2" corresponds to a rotation of approximately 38 degrees, etc. and, finally, an encoding "6" corresponds to a rotation of approximately 110 degrees, in each case from the zero position up to reaching the end sorting position. The blocking cut-outs 20 are accordingly arranged at an angular spacing from the blocking reception recess 34 of the cylinder housing 12 corresponding to the respective encoding when the disk tumblers 16 are in the zero position.

At the encoding "6", a compulsory coupling between the corresponding disk tumbler 16 and the associated section of the key 24 can be provided, i.e. no incision or an incision having the angular dimension 0 degrees is present so that no rotational clearance is present between the key 24 and the disk tumbler 16.

At the encoding "1", in contrast, there is the largest possible rotational clearance between the key 24 and the disk tumbler 16, i.e. an incision 26 having an angular dimension of approximately 90 degrees is provided at the key 24. A disk tumbler 16 of the encoding "1" is thus generally only taken along at the end of the rotational actuation of the key 24, i.e. after a rotation by approximately 90 degrees, and is brought into its end sorting position by a rotation of the key 24 by a further approximately 20 degrees.

A disk cylinder can also have one or more so-called lift disks which generally are disk tumblers. Each lift disk has the encoding "6" and is arranged at a predefined axial position in the disk housing, e.g. at the very front, at the very rear or at the center of the lock cylinder 10 with respect to the key introduction direction. The disk tumbler acting as a lift disk has a compulsory coupling with the key 24. On a key actuation in the unlatching direction, the lift disk serves for the coupling of the key 24 with the disk housing 14 on the completion of the sorting (rotation by 110 degrees) and thus effects a rotational entrainment of the disk housing 14. Starting from the release position of the blocking pin 22, the lift disk ensures, on a key actuation in the latching direction, that the blocking pin 22 is properly raised out of the blocking cut-outs 20 of the disk tumblers 16 (i.e. are urged into the blocking pin reception recess 34) and is not canted, for instance.

It is furthermore customary to arrange intermediate disks 36 between the disk tumblers 16, said intermediate disks being coupled to the disk housing 14 in a rotationally fixed manner or with rotational clearance. The intermediate disks 36 decouple adjacent disk tumblers 16 from one another so that the rotational movement of a respective disk tumbler 16 does not effect a co-rotation of the disk tumbler 16 adjacent thereto due to friction. Such an entrainment could namely have the result that a disk tumbler 16 is under certain circumstances rotated beyond its unlatched position and the lock cylinder 10 can thus no longer be opened.

The rotationally fixed coupling of the intermediate disks 36 with the disk housing can take place by abutment sections 40 of the intermediate disks 36 which extend at least partly in the radial direction (FIG. 26) and which contact corresponding projections 42 formed at the inner wall of the disk housing 14.

Each intermediate disk 36 has a peripheral cut-out 38 which radially aligns with the blocking pin 22. Each intermediate disk 36 accordingly has a further peripheral cut-out **38*a* which radially aligns with the core pin 46 and which is preferably diametrically opposite the peripheral cut-out 38. The dimensions of the peripheral cut-out 38 are adapted to the diameter of the blocking pin 22 so that the intermediate disks 36 do not impede a transposition of the blocking pin 22 into its release position. The same also applies accordingly to the peripheral cut-out 38*a* with respect to the core pin 46**.

Lock cylinders of the above-described kind have proved to be advantageously secure against manipulation. An unauthorized person can nevertheless attempt, using a suitable tool, a so-called picking tool, to probe the individual disk tumblers after one another and hereby to sort them after one another, i.e. to bring them into the respective end sorting position in order subsequently to unlatch the lock cylinder. Attempts could furthermore be made to detect the explained encoding of the disk tumblers, that is the respective angular position of the blocking cut-outs in order to copy a key with suitable incisions.

It is the underlying object of the present invention to improve a lock cylinder of the above-explained kind such that it offers an improved protection against manipulations such as picking. Furthermore, a key and a key blank should be provided which are matched to such a lock cylinder.

The object is satisfied by a lock cylinder having a cylinder housing, a disk housing rotatably supported about a cylinder axis in the cylinder housing and a plurality of rotatably supported disk tumblers arranged along the cylinder axis in the disk housing, wherein each disk tumbler has a reception opening for a key, a blocking cut-out at the outer periphery for an at least partial reception of a blocking pin aligned in parallel with the cylinder axis, and a fixing cut-out provided offset from the blocking cut-out at the outer periphery for an at least partial reception of a core pin aligned in parallel with the cylinder axis, and wherein the disk tumblers are rotatable from a starting position with a removed key into an end sorting position by a rotation of the introduced key in the unlatching direction, in which end sorting position the blocking cut-outs of all the disk tumblers are oriented in alignment with one another, viewed in the direction of the cylinder axis, wherein the fixing cut-outs of all the disk tumblers are oriented in alignment with one another in the end sorting position viewed in the direction of the cylinder axis, wherein the lock cylinder is adapted such that, on a further rotation of the disk tumblers out of the end sorting position in the unlatching direction, first the core pin engages into the fixing cut-outs and only then the blocking pin engages into the blocking cut-outs.

In this lock cylinder, the blocking cut-outs of all the disk tumblers are oriented in alignment with one another in the direction of the cylinder axis in the end sorting position. The blocking pin, however, does not yet immediately move into the blocking cut-outs in the end sorting position, but only on a further rotation of the disk tumblers in the unlatching direction beyond the end sorting position after the core pin has engaged into the fixing cut-outs of the disk tumblers. In other words, a time sequence is defined for the engagement of the core pin into the fixing cut-outs and for the engagement of the blocking pin into the blocking cut-outs. The disk tumblers are fixed with respect to one another (and relative to the disk housing) by the core pin engaging into the fixing cut-outs so that they can no longer be rotated individually (i.e. relative to one another) after the reaching of the end sorting position and a slight further rotation in the unlatching direction. A picking of the lock cylinder in that the disk tumblers are rotated individually by means of a picking tool and the reaching of the end sorting position is recognized in that the blocking pin is set into the blocking cut-outs oriented in alignment with the blocking pin is thus no longer possible. It is in particular hereby prevented that the blocking pin can be urged radially inwardly by the application of a torque and that the contact of the blocking pin at the lateral boundary of the blocking cut-out of this individual disk tumbler can be probed at the same time by a rotation of an individual disk tumbler (in order to successively detect the encodings of the individual disk tumblers in this manner).

Said fixing cut-out of a respective disk tumbler into which the core pin engages in the end sorting position is preferably one of a plurality of fixing cut-outs which are of a similar design and which are formed next to one another at the outer periphery of the respective disk tumbler, viewed in the peripheral direction. The fixing cut-outs or the radially outwardly projecting transition regions between two respective fixing cut-outs can serve as chatter marks on the rotation of the respective disk tumbler (i.e. causing a rattling of the core pin). In addition, the fixing cut-outs are not suitable for a picking attempt since the "correct" position of the disk tumbler cannot be determined using the fixing cut-outs due to the plurality of fixing cut-outs present in a disk tumbler. The lock cylinder is thus characterized by a particularly high protection against manipulations and in particular against picking.

The core pin can move inwardly and in so doing fix the disk tumblers relative to the disk housing by the core pin engaging into the fixing cut-outs of the disk tumblers. In addition, a blocking of the disk housing with respect to the cylinder housing effected by the core pin can be released. The blocking pin can additionally move radially inwardly due to the subsequent engagement of the blocking pin into the blocking cut-outs and a blocking of a rotation of the disk housing with respect to the cylinder housing effected by the blocking pin can be canceled. Once the core pin and the blocking pin have moved inward, the disk housing can be further rotated together with the disk tumblers in the unlatching direction up to the unlatched position.

To achieve a defined movement sequence, a compulsory guidance is preferably provided both for the explained engagement of the core pin into the fixing cut-outs and for the explained engagement of the blocking pin into the blocking cut-outs, i.e. the core pin is urged into the fixing cut-outs and the blocking pin is urged into the blocking cut-outs.

The core pin preferably engages into a core pin reception recess provided at the inner wall of the cylinder housing in the end sorting position of the disk tumblers and the lock cylinder is adapted such that the core pin is urged radially inwardly into the fixing cut-outs by a rotation of the key out of the end sorting position in the unlatching direction. The core pin can block a rotation of the disk housing with respect to the cylinder housing by the engagement into the core pin reception recess. This blocking is released once the core pin has moved radially inwardly into the fixing cut-outs. The disk tumblers are fixed with respect to the disk housing by the engagement of the core pin into the fixing cut-outs so that they are no longer individually rotatable with respect to the disk housing, but rather only the disk housing and the disk tumblers can be rotated together in the unlatching direction.

The core pin reception recess or the cylinder housing can in particular have a core pin guide chamfer which bounds the core pin reception recess, viewed in the unlatching direction, and which is adapted to urge the core pin radially inwardly into the fixing cut-outs. It can be achieved by the core pin guide chamfer that, at a defined position of angular rotation, the core pin Is urged beyond the end sorting position into the fixing cut-outs after the further rotation of the key or of the disk housing. The transfer of the rotational movement of the key toward the disk housing can take place in this respect via a abutment of a lift disk and/or via a respective abutment of the disk tumblers.

In accordance with a preferred further development of the invention, the lock cylinder is adapted such that the blocking pin engages into a blocking pin reception recess provided at the inner wall of the cylinder housing in the end sorting position of the disk tumblers and such that, once the core pin has been urged into the fixing cut-outs, the blocking pin is urged radially inwardly into the blocking cut-outs by a further rotation of the key in the unlatching direction. The blocking pin fixes the disk housing against rotation at the cylinder housing by the engagement of the blocking pin into the blocking pin reception recess. Once the blocking pin has been urged radially inwardly, the disk housing can be further rotated in the unlatching direction with respect to the cylinder housing until reaching the unlatched position.

A blocking pin guide chamfer is preferably provided at the cylinder housing which bounds the blocking pin reception recess in the unlatching direction and which urges the blocking pin radially inwardly beyond the end sorting position on a further rotation of the key or of the disk housing in the unlatching direction. It can be achieved in a simple manner by the blocking pin chamfer that the blocking pin is guided radially inwardly at a defined position of angular rotation.

Viewed in the direction of rotation, the core pin reception recess of the cylinder housing into which the core pin engages in the end sorting position preferably extends over a smaller peripheral angle than the blocking pin reception recess of the cylinder housing into which the blocking pin engages in the end sorting position. Starting from the end sorting position of the disk tumblers, the blocking pin can thus have a greater rotational clearance within the blocking pin reception recess in the unlatching direction than the core pin within the core pin reception recess.

This different rotational clearance is in particular present in the unlatching direction, starting from the end sorting position. In this respect, the core pin reception recess can be bounded in the unlatching direction by said core pin guide chamfer and the blocking pin reception recess of the cylinder housing can be bounded in the unlatching direction by said blocking pin guide chamfer, wherein the angular spacing between the core pin and the core pin guide chamfer is smaller in the end sorting position than the angular spacing between the blocking pin and the blocking pin guide chamfer.

The core pin reception recess and the blocking pin reception recess preferably lie at least substantially diametrically opposite with respect to the cylinder axis. The core pin and the blocking pin are correspondingly preferably at least substantially diametrically opposite one another.

At least one lift disk is preferably provided which is arranged in parallel with the disk tumblers and which is rotatably supported in the disk housing and which likewise has a reception opening (in particular a central reception opening) for the key, wherein the lift disk is coupled in a compulsory manner with the introduced key with respect to a rotation of the key. The compulsory coupling between the key and the lift disk can in particular be achieved in that the lift disk and the associated incision of the key have the initially explained encoding "6". There is thus no rotational clearance between the key and the lift disk. The lift disk therefore always co-rotates on the rotation of the key.

This lift disk is preferably arranged in the disk housing in front of the disk tumblers, with respect to the key introduction direction, i.e. in the region of the distal end of the lock cylinder remote from the key introduction opening. The lift disk can, however, also be arranged at another point in the disk housing, e.g. behind the disk tumblers or in the center between the disk tumblers.

Like the disk tumblers, the lift disk preferably has at least one fixing recess at its outer periphery for the at least partial reception of the core pin. The lift disk, like the disk tumblers, preferably has a plurality of fixing cut-outs which are disposed next to one another, viewed in the peripheral direction, and which can also act as chatter marks on the rotation of the disk tumblers or of the lift disk.

In accordance with an advantageous embodiment, a control element is associated with the lift disk and is supported in a slit of the disk housing, wherein the control element can in particular be movable in a radial direction. The lift disk can be utilized by means of such a control element to control different movement procedures of the coupling and decoupling with a high precision.

The lift disk preferably has a control cut-out at its outer periphery for an at least partial reception of the control element. The lift disk can selectively be fixed at the disk housing by engagement of the control element into the control cut-out so that the lift disk and the disk housing can only be rotated together.

The control element preferably engages into the control cut-out of the lift disk in the starting position, that is with a removed key. The control element thus fixes the disk housing and the lift disk to one another in the starting position. The lift disk thus has a defined alignment in the starting position so that the key can be introduced without problem. Provision can additionally be made that the core pin engages into a fixing cut-out of the lift disk in the starting position and thereby likewise fixes the lift disk at the disk housing.

In accordance with an embodiment of the invention, the disk housing and the lift disk (in particular together with the disk tumblers) are rotatable from an initial position, that is with a key which is introduced but not yet rotated, in the latching direction into a zero position in which the control element engages radially outwardly into a control element reception recess formed at the inner wall of the cylinder housing and moves out of engagement with the control cut-out of the lift disk. The disk housing is fixed in the zero position with respect to the cylinder housing by the engagement of the control element into the control element reception recess. In addition, the fixing effected by the control element between the starting position and the zero position between the disk housing and the lift disk is canceled as soon as the control element is out of engagement with the control cut-out of the lift disk. The core pin can preferably also move out of engagement with said fixing cut-out of the lift disk in the zero position in that the core pin is urged radially outwardly into said core pin reception recess of the cylinder housing in the zero position. A blocking of a rotation of the lift disk with respect to the disk housing effected by the core pin is thus canceled. The lift disk can therefore be rotated starting from the zero position in the unlatching direction with respect to the disk housing.

The zero position, which relates to the sorting of the disk tumblers, can thus be set or controlled in a simple manner by means of the lift disk and the control element.

The lift disk can preferably be rotated from the zero position up to the end sorting position with respect to the disk housing, whereas the disk housing is in particular fixed at the cylinder housing by engagement of the control element into the control element reception recess. The key coupled to the lift disk in a compulsory manner can thus be rotated further from the zero position into the end sorting position. All the disk tumblers are sorted on reaching the end sorting position, i.e. the blocking cut-outs of the disk tumblers are brought into alignment with one another.

In accordance with a preferred embodiment of the invention, the lift disk has a peripheral cut-out at it outer periphery for the at least partial reception of the control element. The peripheral cut-out is in particular formed offset from said control cut-out, viewed in the peripheral direction, at the outer periphery of the lift disk, with the peripheral cut-out forming a further control cut-out.

The control element preferably engages in the end sorting position (and preferably already during the sorting of the disk tumblers) into a control element reception recess which is formed at the inner wall of the cylinder housing and which preferably corresponds to the already mentioned control element reception recess, wherein the peripheral cut-out of the lift disk is oriented in alignment with the control element in the end sorting position, viewed in the radial direction, in order subsequently to be able to partly receive the control element. The disk housing is fixed at the cylinder housing in the end sorting position by engagement of the control element into the control element reception recess.

The lock cylinder is preferably adapted such that the control element is urged—in particular by a rotation of the lift disk in the unlatching direction out of the end sorting position—radially inwardly into the peripheral cut-out of the lift disk. The control element in this respect moves out of engagement with the control element reception recess, whereby the fixing of the disk housing at the cylinder housing effected by the control element is canceled. In addition, the control element moves into engagement with the peripheral cut-out so that the control element effects a fixing of the lift disk at the disk housing.

A control element chamfer is particularly preferably provided at the cylinder housing (in particular at the inner wall of the cylinder housing) which bounds the control element reception recess, viewed in the unlatching direction, and which—on the rotation of the lift disk in the unlatching direction out of the end sorting position—urges the control element radially inwardly into the peripheral cut-out of the lift disk. The control element can thus in a simple manner be brought out of engagement with the control element reception recess, be urged radially inwardly and be brought into engagement with the peripheral cut-out of the lift disk. After reaching the end sorting position, a control of the time or of the angular position for the decoupling of the disk housing from the cylinder housing or for the coupling of the disk housing with the lift disk and thus with the key is hereby possible.

In accordance with a further development of the invention, the control element reception recess which is provided at the cylinder housing extends, viewed in the unlatching direction, over a peripheral angle which is smaller than or at most as large as the peripheral angle of a core pin reception recess (in particular the already named core pin reception recess) into which the core pin engages in the end sorting position. The core pin reception recess therefore offers at least the same rotational clearance for the core pin in the end sorting position as the control element reception recess for the control element so that the explained procedure control is determined by the interplay of the control element with the control element reception recess.

This different rotational clearance is in particular present in the unlatching direction, starting from the end sorting position. In this respect, the control element reception recess of the cylinder housing can be bounded in the unlatching direction by said control element guide chamfer and the core pin reception recess can be bounded in the unlatching direction by said core pin guide chamfer, wherein the angular spacing between the control element and the control element guide chamfer corresponds at most to the angular distance between the core pin and the core pin guide chamfer in the end sorting position, and wherein the former is preferably smaller than the latter.

In accordance with a preferred embodiment of the invention, the lift disk has an abutment at the outer periphery which moves into contact with a counter-abutment provided at the disk housing on a rotation of the lift disk from the starting position in the unlatching direction on a reaching of the end sorting position. The disk housing is co-rotated due to the interplay between the abutment and the counter-abutment by a further rotation of the lift disk in the unlatching direction out of the end sorting position. The control element can be brought out of engagement with the control element reception recess in the inner wall of the cylinder housing and into engagement with the peripheral cut-out of the lift disk by this rotational movement. In addition, the core pin can be urged radially inwardly such that it moves out of engagement with the core pin reception recess and into engagement with the fixing cut-out provided at the outer periphery of the lift disk. In addition, the core pin moves into engagement with the fixing cut-outs of the disk tumblers aligned in the end sorting position. The core pin can thus fix all the disk tumblers against a rotation at the disk housing on a further rotation of the key beyond the end sorting position. The blocking pin can only then—on the further rotation of the disk tumblers in the unlatching direction—be urged radially inwardly out of the blocking pin reception recess into the blocking cut-outs of the disk tumblers and thus a further rotation of the disk tumblers and of the disk housing up to the reaching of the unlatched position can be released.

Alternatively or additionally, the lift disk has a further abutment at the outer periphery which moves into contact with a further counter-abutment provided at the disk housing on a rotating back of the lift disk from the end sorting position in the latching direction (in particular on reaching said zero position). The disk housing can be co-rotated due to the interplay between the further abutment and the further counter-abutment by a further rotation of the lift disk in the latching direction (in particular out of the zero position). The control element can be brought out of engagement with the control element reception recess in the inner wall of the cylinder housing and into engagement with the control cut-out of the lift disk by the rotational movement of the disk housing. In addition, the core pin can be urged radially inwardly out of the core pin reception recess such that the core pin moves out of engagement with the core pin reception recess and into engagement with the fixing cut-out provided at the outer periphery of the lift disk. In this respect the core pin also moves into engagement with the fixing cut-outs of the disk tumblers (oriented in the zero position, viewed in the radial direction, in alignment with the core pin reception recess) so that the core pin fixes all the disk tumblers against a rotation at the disk housing on the further rotation of the key in the latching direction beyond the zero position. The disk housing with the disk tumblers fixed at the disk housing and the lift disk fixed at the disk housing via the control element and the core pin can thus be rotated back into the initial position in which the key can be removed.

The control element can in particular be a pin-like control element such as a control pin which is preferably aligned in parallel with the cylinder axis. The control element can, however, also be formed by a ball, for example.

The control element is preferably offset along the cylinder axis with respect to the blocking pin, but is arranged in the same angular position, i.e. the control element is oriented at least substantially in alignment with the blocking pin (except for a possible radial displacement), viewed in the direction of the cylinder axis. A two-part control pin arrangement is provided in this respect which comprises the blocking pin and the control element which is separate therefrom and which is independently movable. The control element configured as a pin can in particular be received in the same slit of the disk housing as the blocking pin. The blocking pin thus cooperates with the blocking cut-outs of the disk tumblers, but not with the explained lift disk. The blocking pin can, however, cooperate with at least one other lift disk.

In contrast, the core pin preferably cooperates both with the lift disk and with the disk tumblers. The slit of the disk housing for the reception of the blocking pin and of the control element can preferably be configured in the form of an aperture of the disk housing extending in the direction of the cylinder axis. The same preferably applies to the slit of the disk housing for the reception of the core pin.

With an introduced key, the disk housing and the disk tumblers (which are in particular coupled to the disk housing via the core pin) preferably can be rotated together in the unlatching direction from the starting position up to a zero position or to the already named zero position.

The disk tumblers can be individually rotatable in a manner known per se between the zero position and the end sorting position relative to the disk housing. The disk tumblers can be sorted in a manner known per se by a rotation of the key between the zero position and the end sorting position. In the end sorting position, the blocking cut-outs and the fixing cut-outs of all the disk tumblers are each oriented in alignment with one another, viewed in the direction of the cylinder axis. In addition, the blocking cut-outs of the disk tumblers are oriented radially in alignment with the blocking pin reception recess of the cylinder housing and the fixing cut-outs of the disk tumblers oriented in alignment with the blocking pin reception recess of the cylinder housing, viewed in the direction of the cylinder axis, are aligned, viewed in the radial direction, with the core pin reception recess of the cylinder housing.

In accordance with a preferred further development of the invention, the lock cylinder has at least one blocking element which is also called a rotary slide block and which is arranged, with respect to a key introduction direction, in front of the disk tumblers (and in particular in front of the disk housing). The blocking element is thus located at a distal end of the disk housing. In addition, the blocking element is rotationally fixedly coupled to the disk housing.

An additional blocking of the disk housing relative to the cylinder housing can thus be effected by the blocking element. The blocking element is preferably movable by a rotation of the key in an unlatching direction out of blocking position in which the blocking element engages into a reception recess of the cylinder housing into a release position in which the blocking element is out of engagement with the reception recess. A simple introduction of the key into the lock cylinder is in contrast not sufficient for the actuation of the blocking element. The lock cylinder can thus not be unlatched by a non-matching key which cannot actuate the blocking element in the intended manner. The security against manipulation can therefore be even further increased by the blocking element.

Where reference is made in connection with the invention to the "introduction direction" of the key, the indications "in front of" or "at the front" generally designate a position disposed in the introduction direction and the indications "behind" or "at the rear" designate a position against the introduction direction.

The blocking element can have a driven flank which cooperates with a drive flank formed at the tip of the key such that the blocking element is moved out of the blocking position into the release position by a rotation of the key in the unlatching direction. The blocking element and the key tip can thus come into contact with one another via said flanks in order to bring the blocking element into the release position by a rotation of the key in the unlatching direction.

The driven flank of the blocking element and the drive flank at the tip of the key are preferably adapted and cooperate with one another such that the two flanks only contact one another when the key is rotated from an initial position which the key adopts after the introduction into the lock cylinder at least into a first rotational position. The first rotational position in this respect preferably corresponds to a rotational position which the key adopts after passing the already named zero position (in which the disk tumblers are released for a rotational movement relative to the disk housing) briefly before reaching said end sorting position.

In accordance with a further development of the invention, the driven flank of the blocking element and the drive flank at the tip of the key are furthermore adapted and cooperate with one another such that the blocking element moves out of the blocking position into the release position while the key is rotated from the first rotational position in the unlatching direction into a second rotational position. The second rotational position is preferably the already named end sorting position in which the disk tumblers are sorted and the blocking cut-outs of the disk tumblers are oriented in alignment with one another in the direction of the cylinder axis. The reception openings of the disk tumblers can, in particular together with at least one lift disk, form said keyway (preferably with an at least substantially rectangular cross-sectional shape) in the starting position of the lock cylinder, wherein said driven flank of the blocking element is preferably arranged outside the keyway, i.e. does not project into the keyway, viewed in axial alignment. The securing against picking can thus be increased since the blocking element can only be accessed and actuated with difficulty via the keyway.

The tip of the key preferably has a cross-sectional shape having two narrow sides and two broad sides which are longer than the narrow sides, wherein the blocking element can be driven to make the movement out of the blocking position into the release position by means of one of the broad sides of the key tip. The drive flank can thus be formed by a broad side of the key tip.

In accordance with an embodiment of the invention, the blocking element can be co-rotated on the rotation of the key in the unlatching direction from an initial position which the key adopts after the introduction into the lock cylinder into a first rotational position or into the already named first rotational position such that the blocking element initially remains in the blocking position. For this purpose, the reception recess at the inner wall of the cylinder housing into which the blocking element engages in the blocking position is preferably larger in the peripheral direction than the extent of the end of the blocking element projecting into the reception recess in the peripheral direction. The blocking element thus has a rotational clearance relative to the cylinder housing in its blocking position. This rotational clearance is preferably present starting from an initial position of the lock cylinder, i.e. after introduction of the key, the rotational clearance first has to be overcome and a further rotation of the key only then effects the movement of the blocking element out of the blocking position into the release position.

The reception recess at the inner wall of the cylinder housing preferably has a first abutment surface for an end of the blocking element projecting into the reception recess (in particular the already named end) which the end of the blocking element comes into contact with when the key is rotated in the unlatching direction from an initial position which the key adopts after the introduction into the lock cylinder into a first rotational position (in particular into the already named first rotational position, wherein the first abutment surface blocks a further rotation of the blocking element in the unlatching direction. When the first rotational position is reached, the blocking element thus has to be brought into the release position because otherwise a further rotation in the unlatching direction is not possible. No unlatching of the lock cylinder is thus possible using a non-matching key which cannot actuate the blocking element as intended.

The reception recess of the cylinder housing preferably has a second abutment surface for the end of the blocking element projecting into the reception recess, wherein the end of the blocking element contacts the second abutment surface with a removed key and the second abutment surface blocks a rotation of the blocking element against the unlatching direction. With a removed key, that is in the starting position, a defined position thus results for the blocking element and for the disk housing coupled therewith.

In accordance with a further development of the invention, the blocking element is linearly displaceably supported in a normal plane to the cylinder axis. The blocking element is in particular movable from the blocking position into the release position at least substantially in a direction transverse to the cylinder axis. The blocking element can be linearly displaceably supported with respect to the cylinder axis in a radial direction or in a direction which extends in parallel with a radial direction.

The blocking element is preferably preloaded in the direction of the blocking position, in particular by means of a spring. The blocking element can thereby be held in the blocking position, in particular with a removed key.

In accordance with a preferred further development of the invention, a further blocking element which is also called a slide block is arranged in front of the disk tumblers (and in particular in front of the disk housing), with respect to the key introduction direction. The further blocking element is thus located at the distal end of the disk housing. The further blocking element is likewise preferably rotationally fixedly coupled to the disk housing.

The further blocking element preferably adopts a blocking position with a removed key in which the further blocking element engages into a further reception recess at the inner wall of the cylinder housing and wherein the further blocking element is movable out of engagement with the further reception recess and thus into a release position by introducing the key into the lock cylinder. The further blocking element can therefore (unlike the above-explained blocking element) already be brought out of the blocking position into the release position by a simple axial introduction of the matching key.

The blocking element (in particular said rotary slide block) and the further blocking element (in particular said slide block) are preferably arranged next to one another in the same cross-sectional plane of the lock cylinder (i.e. at the same level along the cylinder axis) and are displaceably supported in parallel with one another. With a small construction length, i.e. with a small axial construction space of the lock cylinder, two different latching and unlatching functions can hereby be implemented which become effective at different times or at different positions of the lock cylinder.

The further blocking element is preferably likewise preloaded in the direction of its blocking position, in particular by means of a spring.

The present invention also relates, independently of the presence or of the particular configuration of a core pin and/or of a blocking element, to a lock cylinder which has a plurality of disk tumblers, a blocking pin, at least one lift disk and a control element having the above-described features. The lift disk can be utilized by means of such a control element to control different movement procedures of the coupling and decoupling with a high precision. The setting of the zero position or of the end sorting position which relate to the sorting of the disk tumblers can be controlled, for example, in a simple manner by means of the lift disk and the control element.

The invention in particular also relates to a lock cylinder having a cylinder housing, a disk housing rotatably supported about a cylinder axis in the cylinder housing and a plurality of rotatably supported disk tumblers arranged along the cylinder axis in the disk housing, wherein each disk tumbler has a reception opening for a key and a blocking cut-out at the outer periphery for the at least partial reception of a blocking pin aligned in parallel with the cylinder axis, wherein the disk tumblers are rotatable from a starting position with a removed key by a rotation of the introduced key in the unlatching direction into an end sorting position in which the blocking cut-outs of all the disk tumblers are oriented in alignment with one another, viewed in the direction of the cylinder axis, to receive the blocking pin, wherein the lock cylinder furthermore has at least one lift disk which is arranged in parallel with the disk tumblers in the disk housing and is rotatably supported and which has a reception opening for the key, wherein the lift disk is compulsorily coupled with the introduced key with respect to a rotation of the key, and wherein a control element is associated with the lift disk and is supported in a slit of the disk housing, wherein the control element is offset along the cylinder axis with respect to the blocking pin.

The lift disk can have a control cut-out at its outer periphery for the at least partial reception of the control element. The control element can in this respect engage into the control cut-out of the lift disk in the starting position of the lock cylinder with a removed key in order to fix the disk housing and the lift disk to one another. The disk housing and the lift disk can be rotatable from an initial position of the lock cylinder, with a key which is introduced but not yet rotated, in the unlatching direction into a zero position and the lock cylinder can be adapted such that the control element is urged in the zero position radially outwardly into a control element reception recess of the cylinder housing and is brought out of engagement with the control cut-out of the lift disk in order to fix the disk housing relative to the cylinder housing and to release the lift disk for a rotation from the zero position up to the end sorting position relative to the disk housing.

Alternatively or in addition to said control cut-out, the lift disk can have a peripheral cut-out at its outer periphery for the at least partial reception of the control element. The control element can in this respect engage into a control element reception recess (or into the already named control element reception recess) of the cylinder housing in the end sorting position, wherein the peripheral cut-out of the lift disk is aligned in the radial direction with the control element in the end sorting position. The lock cylinder can be adapted such that the control element is urged radially inwardly in the unlatching direction out of the control element reception recess by a rotation of the lift disk out of the end sorting position and in so doing engages into the peripheral cut-out of the lift disk to cancel the fixing of the disk housing at the cylinder housing and to effect a fixing of the lift disk at the disk housing.

The control element is preferably arranged in the same angular position as the blocking pin. In this respect, the blocking pin and the control element can together form a blocking pin which is divided (along the cylinder axis).

The control element is in particular a pin-like control element such as a control pin which is preferably aligned in parallel with the cylinder axis. The control element can, however, also be formed by a ball, for example.

The cylinder housing can have the already named blocking pin reception recess for the reception of the blocking pin and the already named control element reception recess for the reception of the control element, wherein the control element reception recess is preferably offset along the cylinder axis with respect to the blocking pin reception recess, but is arranged in the same angular position, and wherein the control element reception recess and the blocking pin reception recess are preferably formed by a continuous recess along the cylinder axis at the inner wall of the cylinder housing. The control element reception recess can, however, have a smaller extent in the peripheral direction than the blocking pin reception recess.

The invention also relates to a key or to a key blank, in particular for a lock cylinder of the explained kind, comprising a shaft whose tip is adapted to cooperate with a blocking element provided in the lock cylinder, wherein the shaft has two broad sides and two narrow sides, wherein the shaft tip has two broad sides, two narrow sides and an end face, and wherein a flattened portions set back relative to a plane of the broad side of the shaft is provided at least one broad side of the shaft tip.

The flattened portion at the shaft tip in this respect in particular makes it possible that the key can be introduced into an associated keyway in a starting position of the lock cylinder (corresponding to the already named initial position) without the shaft tip abutting a blocking element of the above-explained kind (in particular at said rotary slide block). The blocking element can notwithstanding have a driven flank which can reach relatively closely to the cylinder axis for a rotary actuation of the blocking element by means of the key. After introduction of the key into the lock cylinder or into said keyway, a drive flank of the shaft tip which can in particular be provided laterally adjacent to the flattened portion of the shaft tip and/or can lie in the plane of the corresponding shaft broad side can thus move into contact with the driven flank of the blocking element on the rotation of the key in the lock cylinder to transpose the blocking element into the release position.

The broad side of the shaft tip can be set back with respect to the plane of the broad side of the shaft in the region of the respective flattened portion. The plane of the broad side of the shaft is preferably an overlapping plane of the outer elements of the broad side of the shaft. Recesses such as a longitudinal groove present in the broad side are set back toward the key axis with respect to this overlapping plane and thus do not lie in said plane of the broad side of the shaft.

The flattened portion is preferably formed along the key axis over the total broad side of the shaft tip. The flattened portion can, however, also be formed only over a part of the broad side of the shaft tip, viewed in the direction of the key axis.

In a direction transverse to the key axis, the flattened portion preferably only extends over a part of the broad side of the shaft tip, whereas another part of the broad side of the shaft tip (in particular the total or almost the total remaining part) can lie in the plane of the corresponding broad side of the shaft.

In accordance with a further embodiment, the flattened portion can only extend over a part of the broad side of the shaft tip in a direction transverse to the key axis, whereas another part of the broad side of the shaft tip (in particular the total or almost the total remaining part) forms the already named drive flank of the shaft tip (or key tip) for transposing the blocking element by a rotation of the key. In this respect, the drive flank can, as explained above, lie in the plane of the corresponding broad side of the shaft. Alternatively or additionally, in this embodiment, the drive flank of the shaft tip can only extend over a part of the broad side of the shaft tip in a direction transverse to the key axis, which part corresponds to a portion in the range from approximately 10% to 50%, in particular to a portion in the range from approximately 20% to 40%, and preferably to a portion of approximately 30%, of the total width of the respective broad side of the shaft tip (these are approximate values here in view of rounded edges and/or transitions). In other words, the drive flank preferably extends over at most half the breadth of the respective broad side of the shaft tip in the transverse direction.

The flattened portion can, however, generally also extend over the total broad side of the shaft tip in the transverse direction.

The flattened portion can extend in parallel with the plane of the broad side of the shaft. The flattened portion can, however, also extend obliquely to the plane of the broad side of the shaft. Alternatively, the flattened portion can extend sectionally in parallel with and sectionally obliquely to the plane of the broad side of the shaft.

The flattened portion is preferably inclined by a predefined angle relative to the plane of the broad side of the shaft, wherein the angle is preferably in the range between 2 and 25 degrees, further preferably between 5 and 20 degrees, and even further preferably between 10 and 15 degrees (in each case respectively including the range borders).

In accordance with a preferred embodiment of the invention, a respective flattened portion is provided at each of the two broad sides of the shaft tip, wherein the two flattened portions are preferably rotationally symmetrical with one another. The key can in this respect preferably be configured in the form of a reversible key.

In accordance with a further development of the invention, the two narrow sides of the shaft tip extend on an oblique and tapering manner in the direction of the end face. The narrow sides thus extend toward the end face toward one another like a roof. An acutely converging shape thereby results at the front end, whereby the key can be inserted more simply into the keyway.

The shaft tip can be set off from the remaining part of the shaft by a peripheral notch at the narrow sides. A defined shaft tip delineated from the remaining shaft thereby results. The notch preferably has a spacing from the front end of the shaft tip which amounts to between 1 mm and 3 mm.

A further peripheral notch can be formed at the narrow sides in a front part of the shaft disposed in the vicinity of the shaft tip. An associated blocking disk provided in the lock cylinder can engage into the further notch on the rotation of the key in the unlatching direction out of the initial position. If no further notch is present, the blocking disk in contrast blocks the rotation so that the security against manipulation can be further increased by the combination of a further notch and an associated blocking disk. The further notch can have a spacing from the front end of the shaft tip which amounts to between 3 mm and 5 mm.

Further advantageous embodiments of the invention are set forth in the dependent claims, in the description and in the drawings.

Figure 2A:
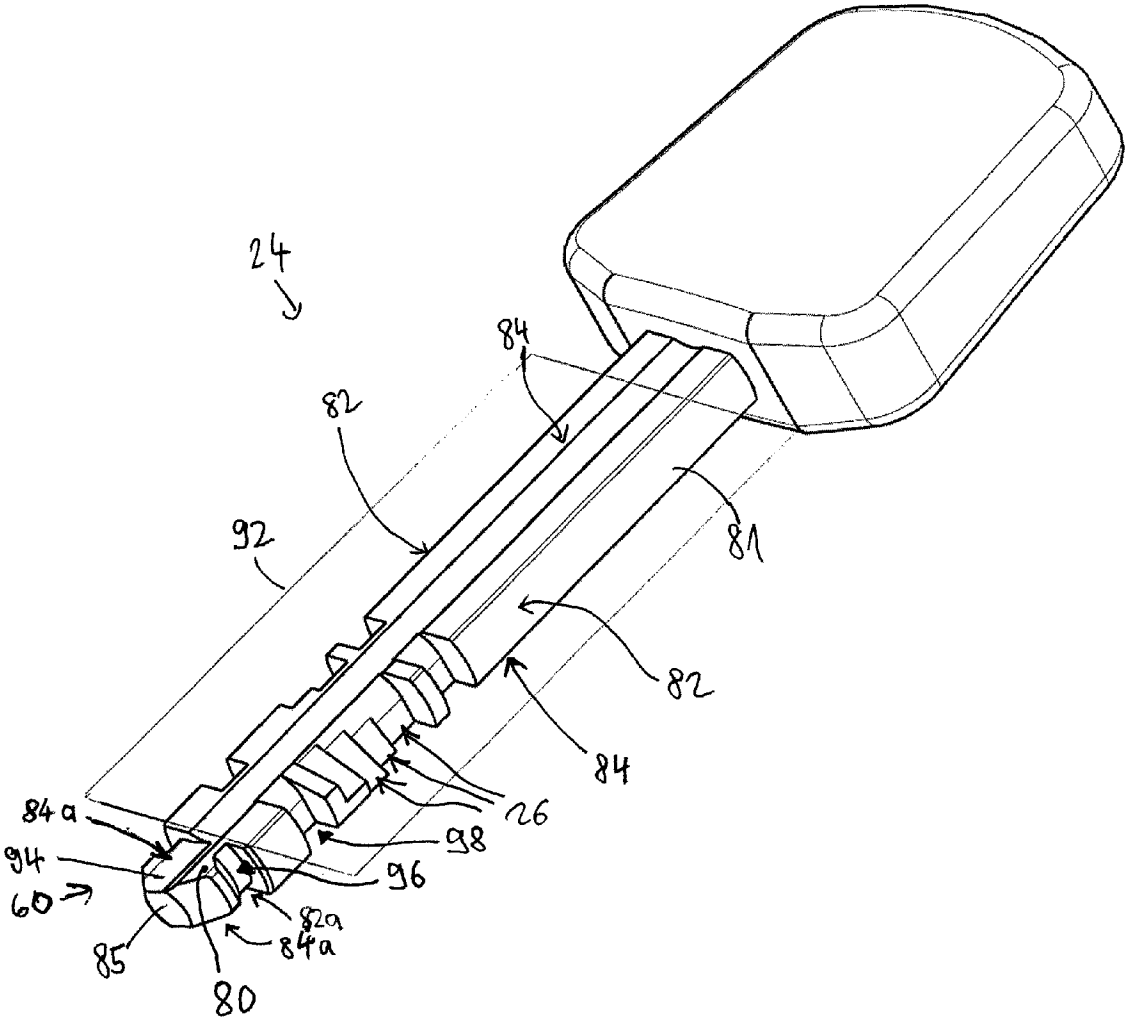
Figure 2B:
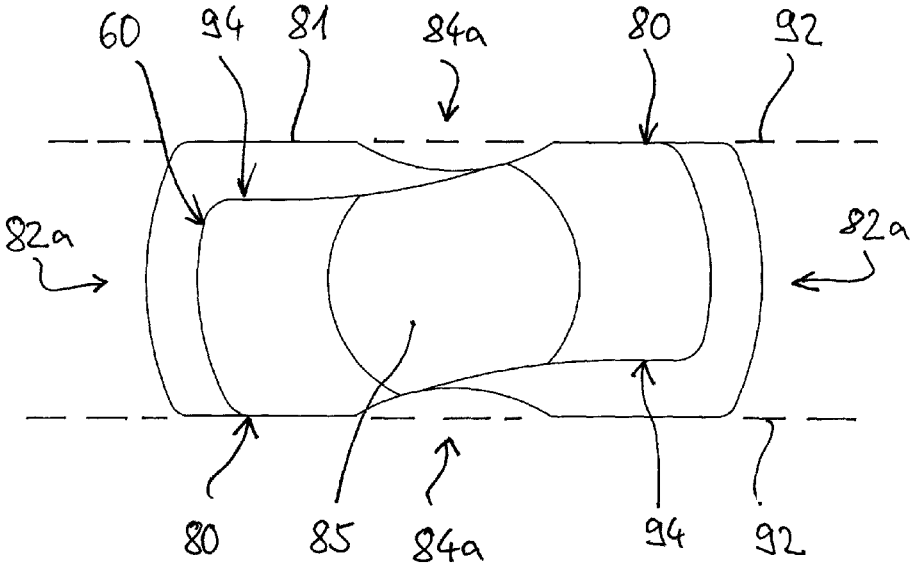
Figure 3:
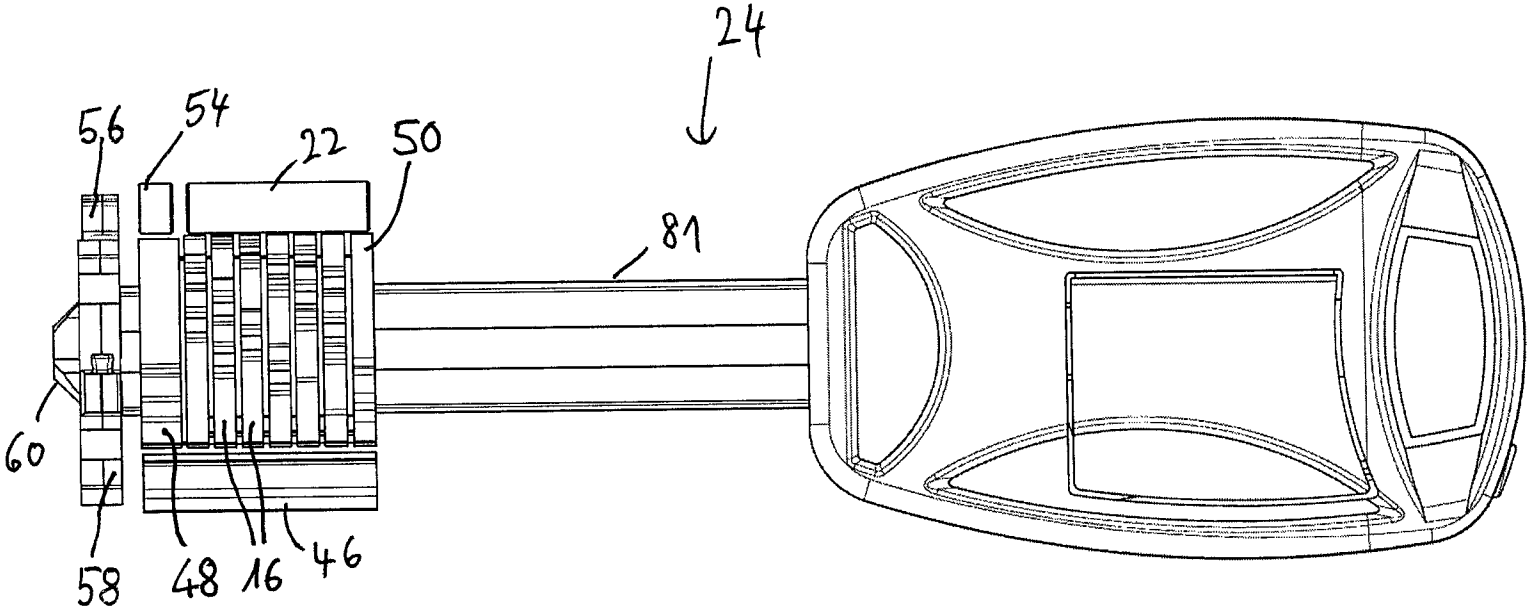
Figure 4:
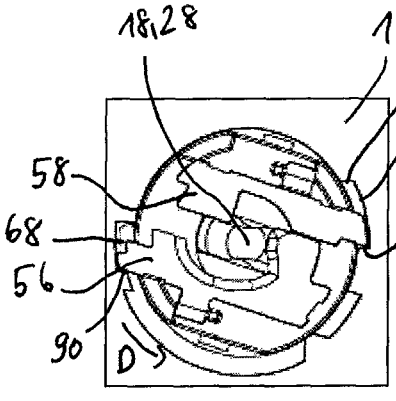
Figure 7:
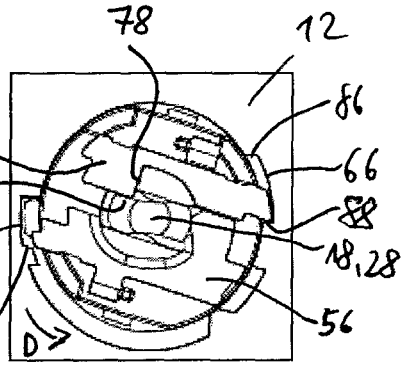
Figure 5:
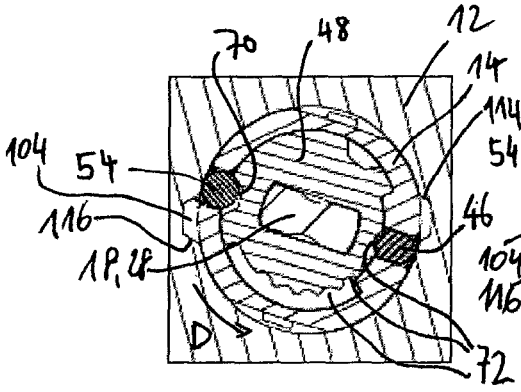
Figure 8:
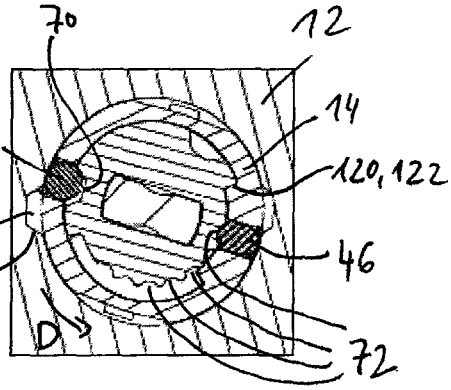
Figure 6:
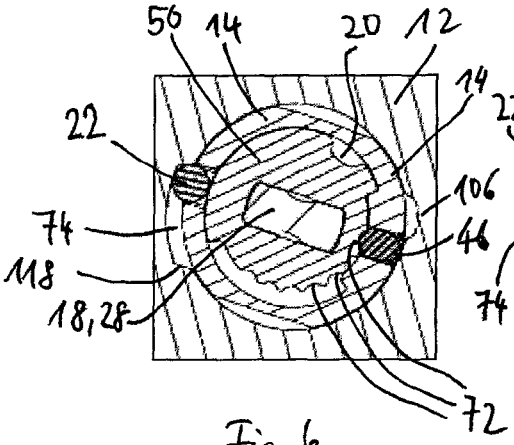
Figure 9:
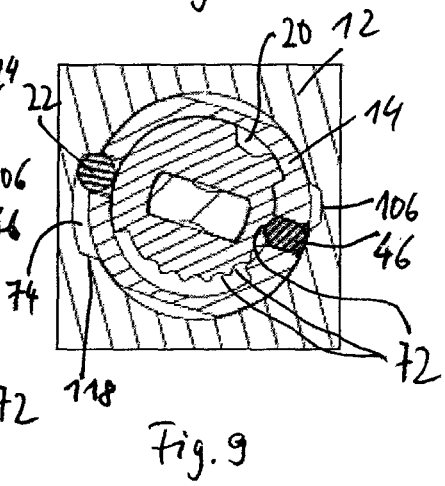
Figure 10:
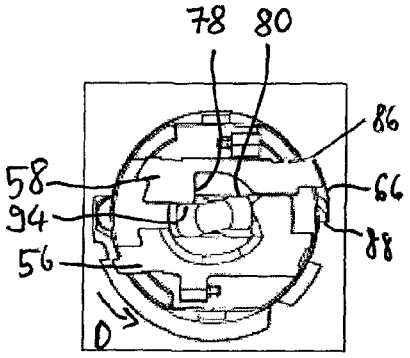
Figure 13:
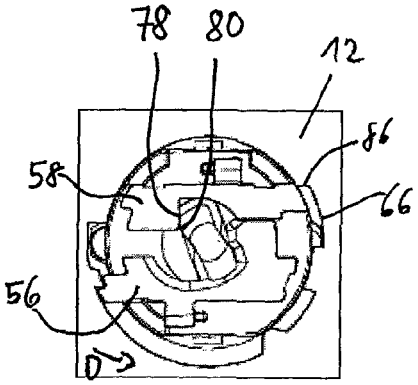
Figure 11:
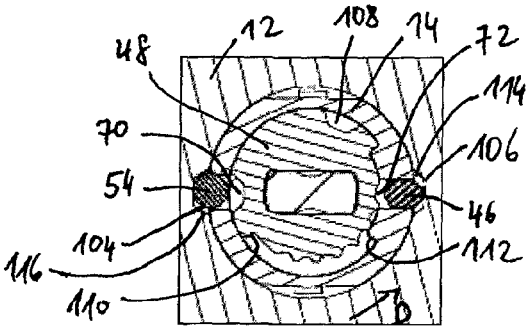
Figure 14:
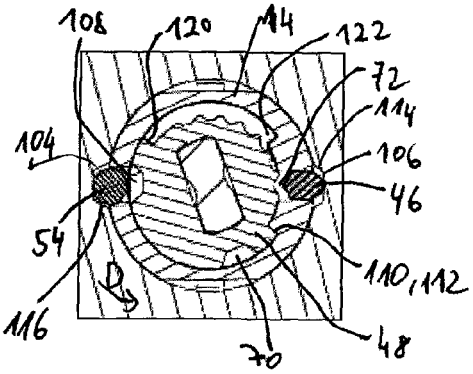
Figure 12:
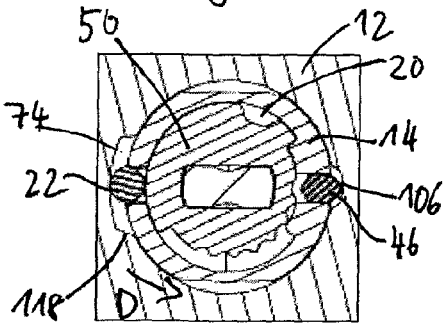
Figure 15:
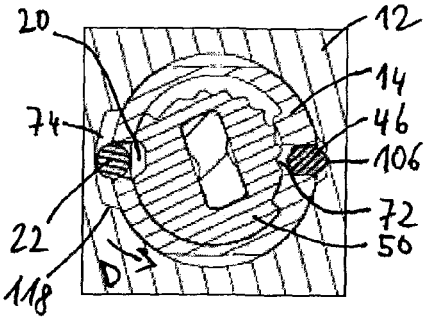
Figure 16:
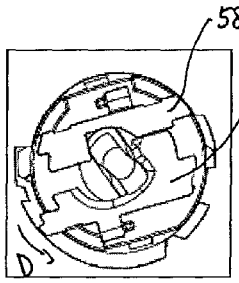
Figure 19:
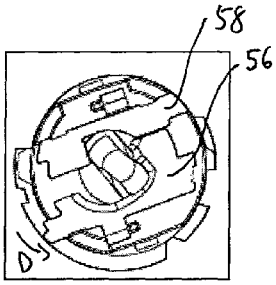
Figure 22:
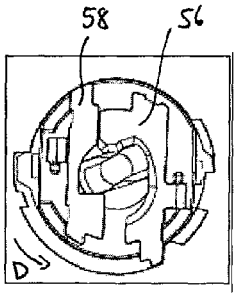
Figure 17:
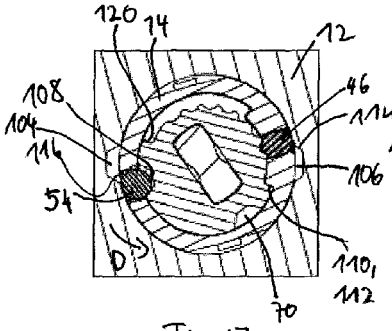
Figure 20:
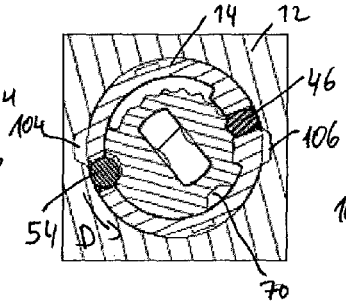
Figure 23:
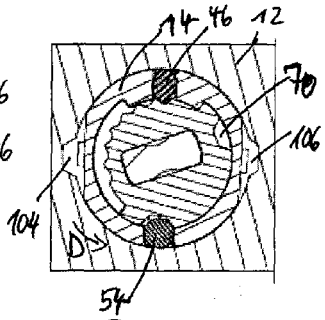
Figure 18:
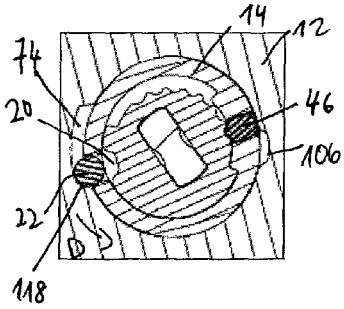
Figure 21:
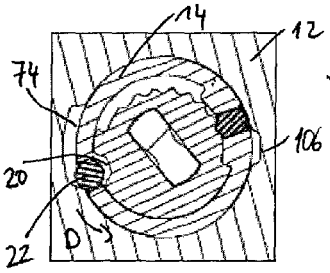
Figure 24:
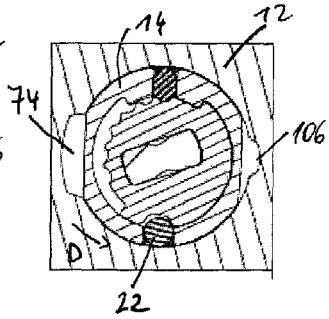
Figure 25:
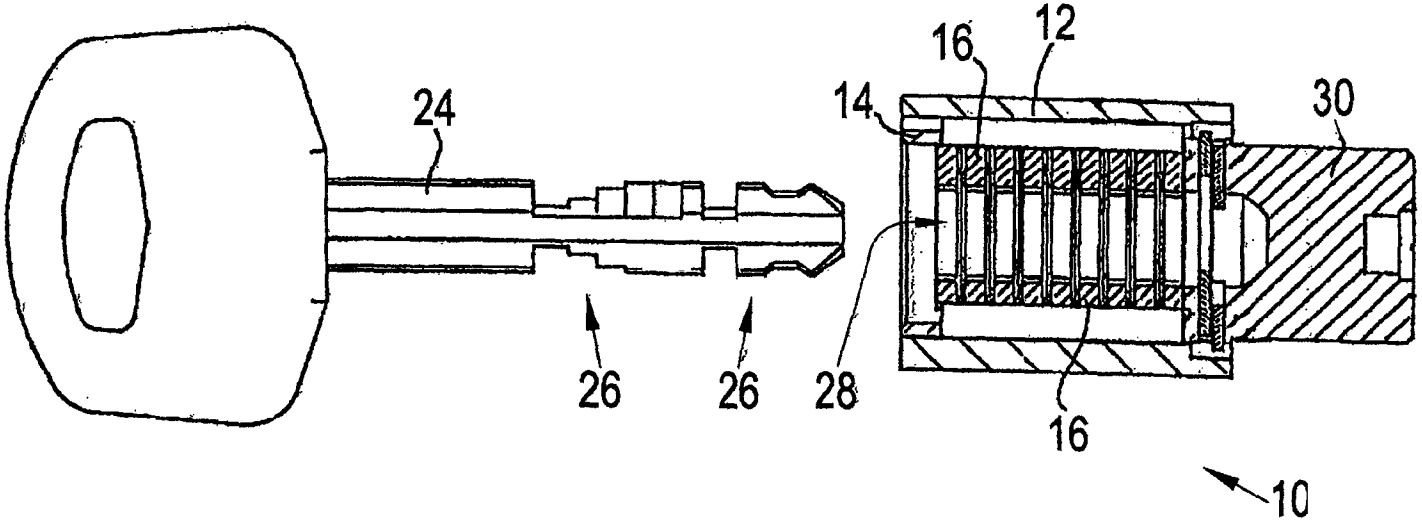
Prior Art Fig.25

The invention will be described in the following with reference to an embodiment and to the drawings. There are shown:

FIG. 1 an exploded representation of a lock cylinder in accordance with the invention with an associated key;

FIGS. 2*a* and 2*b* a perspective view of the key of FIG. 1 or a front view of the key tip;

FIG. 3 a partly sectional side view of the lock cylinder of FIG. 1 with an introduced key;

FIGS. 4 to 6 a cross-sectional view through the lock cylinder of FIG. 1 in a starting position with a withdrawn key, at the level of a rotary slide block, or at the level of a front lift disk, or at the level of a rear lift disk;

FIGS. 7 to 9 a cross-sectional view through the lock cylinder of FIG. 1 in an initial position with a key which is introduced and not yet rotated, at the level of the rotary slide block, or at the level of the front lift disk, or at the level of the rear lift disk;

FIGS. 10 to 12 a cross-sectional view through the lock cylinder of FIG. 1 with a key which is rotated into a zero position, at the level of the rotary slide block, or at the level of the front lift disk, or at the level of the rear lift disk;

FIGS. 13 to 15 a cross-sectional view through the lock cylinder of FIG. 1 with a key which is rotated into an end sorting position, at the level of the rotary slide block, or at the level of the front lift disk, or at the level of the rear lift disk;

FIGS. 16 to 18 a cross-sectional view through the lock cylinder of FIG. 1 with at the level of the rotary slide block, or at the level of the front lift disk, or at the level of the rear lift disk;

FIGS. 19 to 21 a cross-sectional view through the lock cylinder of FIG. 1 with a key which is rotated into an unblocked position, at the level of the rotary slide block, or at the level of the front lift disk, or at the level of the rear lift disk;

FIGS. 22 to 24 a cross-sectional view through the lock cylinder of FIG. 1 with a key which is rotated into an unlatched position, at the level of the rotary slide block, or at the level of the front lift disk, or at the level of the rear lift disk;

FIG. 25 a longitudinal section through a lock cylinder known from the prior art; and FIG. 26 an exploded view of the lock cylinder of FIG. 25.

The lock cylinder 100 in accordance with the invention of FIG. 1 comprises a cylinder housing 12, a disk housing 14 rotatably supported about a cylinder axis in the cylinder housing 12, and a plurality of radially supported disk tumblers 16 which are arranged along the cylinder axis in the disk housing 14 and between which a respective intermediate disk 35 is arranged, in particular supported in a floating manner. A security against rotation of the intermediate disks 36 can be provided by means of an abutment device (not shown).

Each disk tumbler 16 and each intermediate disk 36 has a central reception opening 18 which together form a keyway 28 for the introduction of a key 24. The central reception openings 18 of the disk tumblers 16 in the embodiment shown have a rectangular cross-section, whereas the reception openings 18 of the intermediate disks 36 have a circular cross-section.

Each disk tumbler 16 has a blocking cut-out 20 at its outer periphery for the reception of a blocking pin 22 which is aligned in parallel with the cylinder axis and is radially movably received in a slit (not shown in FIG. 1) provided in the wall of the disk housing 14. Each disk tumbler 16 additionally has at least one fixing cut-out 44 offset from the blocking cut-out 20 at its outer periphery for the reception of a core pin 46 aligned in parallel with the cylinder axis. The core pin 46 is in this respect likewise radially movably received in a slit, which is not shown in FIG. 1, provided in the wall of the disk housing 14.

A lift disk 48 is provided in the disk housing 14 which is at the front—viewed in the introduction direction A of the key 24 into the keyway 28—which is rotatably supported in parallel with the disk tumblers 16 in the disk housing 14 and which likewise has a central reception opening 18 for the key 24. The front lift disk 48 is thus at the distal end of the disk housing 14, viewed from the opening of the keyway 28. The front lift disk 48 is compulsorily coupled with respect to a rotation with the key 24 introduced into the keyway 28. The front lift disk 48 thus always co-rotates when the key 24 is rotated.

The same applies to a rear lift disk 50 which is rotatably supported in the disk housing 14 behind the packet of disk tumblers 16 with respect to the introduction direction A (i.e. at the proximal end of the disk housing 14). In this respect, an intermediate disk 36, in particular supported in a floating manner, is arranged between the adjacent disk tumbler 16 and the rear lift disk 50, as FIG. 1 shows. The disk housing 14 is additionally closed by a cover 52 by which the disks 16, 36, 48, 50 are protected from falling out of the disk housing 14. Like the lift disks 48 and 50, the disk tumblers 16 and the intermediate disks 36, the cover 52 likewise has a central reception opening 18 for forming the keyway 28.

Unlike the lock cylinder 10 which is described with reference to FIGS. 25 and 26 and in which the blocking pin 22 cooperates with the front lift disk not shown in FIGS. 25 and 26, a separate control element 54 formed by a control pin is provided in the lock cylinder 100 of FIG. 1. The control element 54 is provided at the level of the front lift disk 48 and thus adjacent to the blocking pin 22 in the introduction direction A of the key 24 and is arranged radially movably in a separate slit of the disk housing 14 or in the same slit in which the blocking pin 22 is arranged. The control element 54 can also be configured as a ball, for example. At the outer periphery, the front lift disk 48 has a control cut-out 70 (FIGS. 5, 8, 11) and a peripheral recess 108 (FIGS. 14, 17, 20, 23) serving as a further control cut-out for the reception of the control element 54.

Viewed in the introduction direction A of the key 24, a first blocking element formed by a so-called slide block 56 and a second blocking element formed by a so-called rotary slide block 58 are arranged within the same plane in front of the disk housing 14 (i.e. offset to distal) and are linearly movably supported (i.e. along a straight line) in a normal plane to the cylinder axis in parallel with a radial direction with respect to the cylinder axis.

Figure 2B:
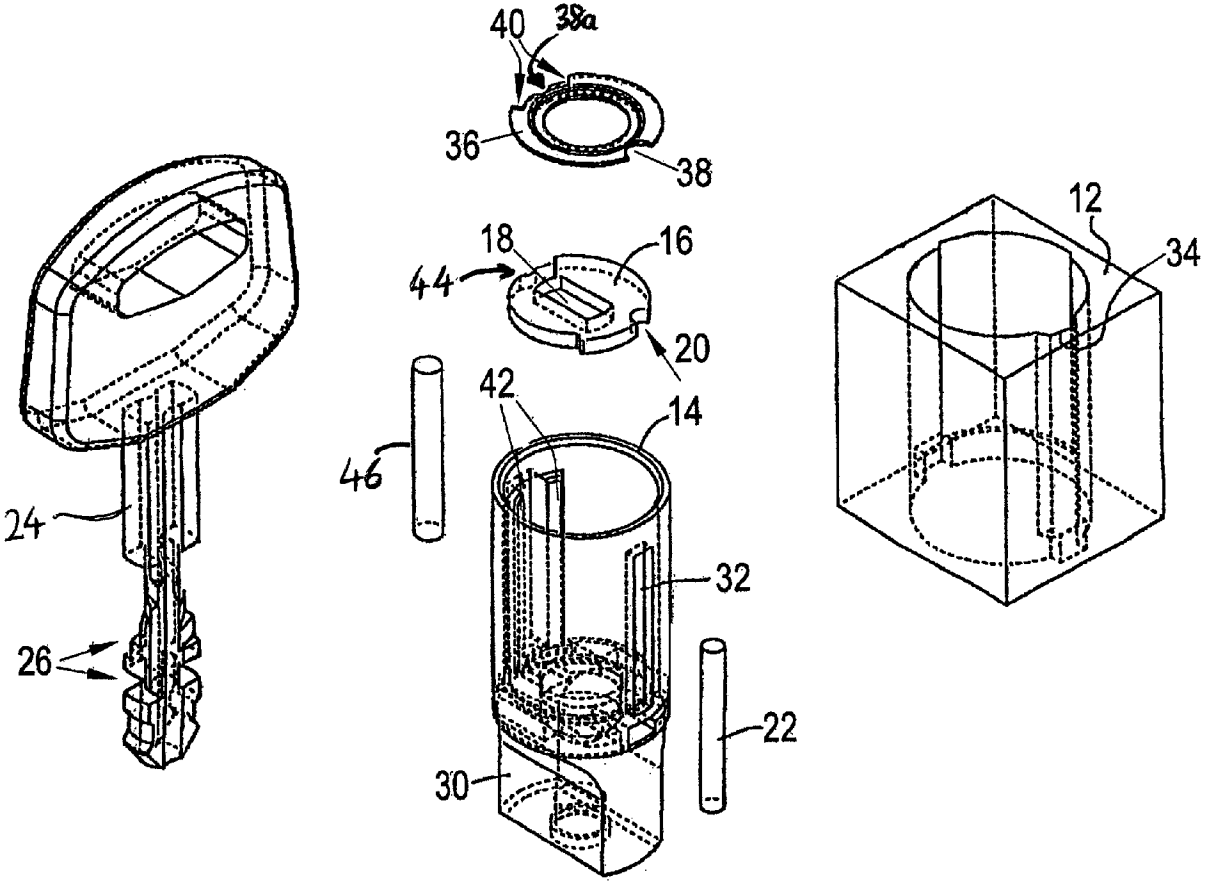
Fig. 2b Prior Art

As FIG. 1 shows, the disk housing 14 likewise has at its end at the front, viewed in the introduction direction A of the key 24, a reception opening 18 through which a tip 60 of the key 24 (cf. FIGS. 1 and 2) projects with a key introduced into the keyway 28. As will be explained in the following, the slide block 56 and the rotary slide block 58 can be actuated via the key tip 60.

An attachment 62 is attached to the end of the disk housing 14 at the front, viewed in the key introduction direction A. The attachment 62 serves as a reception and as a translatory guide for the slide block 56 and the rotary slide block 58 and as a connection member to a lock mechanism, not shown in FIG. 1, so that the latter can be actuated by a rotation of the disk housing (cf. the coupling section 30 in FIG. 25).

Clamps 64 are provided for holding the attachment 62 at the disk housing 14 and the attachment 62 can be clamped tight at the disk housing 14 by them, in particular at mutually opposite sides.

The key 24 shown in FIG. 2*a* has a plurality of differently angled incisions 26 which correspond in a manner known per se to different angular positions of the block cut-outs 20 and of the fixing cut-outs 44 of the disk tumblers 16. The disk tumblers 16 have a specific rotational clearance with respect to the respective associated incision 26 of the key 24 and the angular dimension of the respective incision 26 depends on the dimension of said rotational clearance. In dependence on the angular dimension of the incisions 26, control sections (flanks) of the respective incisions 26 and corresponding control sections (inner walls) of the central reception openings 18 of the associated respective disk tumblers 16 thus come into engagement at different times and in accordance with the encoding provided in the respective incision 26, as has already been described with respect to FIGS. 25 and 26.

The front lift disk 48 and the rear lift disk 50 have the encoding "6" so that the two lift disks 48 and 50 are compulsorily coupled with the key 24 with respect to a rotation.

FIG. 3 shows a longitudinal section through the disk housing 14 and in this respect in particular through the two lift disks 48, 50 with the interposed disk tumblers 16, the blocking pin 22, the core pin 46, the control element 54 and the slide block 56 cooperating with the key tip 60 and the rotary slide block 58 likewise cooperating with the key top 60.

The operation of the lock cylinder 100 of FIG. 1 will be explained with respect to FIGS. 4 to 24 in the following. FIGS. 4 to 6 in this respect represent the situation with a removed key, which will also be called the starting position in the following, in different observation planes (in each case with a direction of view against the key introduction direction A). FIG. 4 shows a cross-section through the lock cylinder at the level of the rotary slide block 58 and of the slide block 56. In the starting position, the rotary slide block 58 adopts a blocking position since the rotary slide block 58 engages into a rotary slide block reception recess 66 provided at the inner wall of the cylinder housing 12. In addition, the slide block 56 adopts a blocking position since the slide block 56 engages into a slide block reception recess 68 provided at the inner wall of the cylinder housing 12. The rotary slide block 58 and the slide block 56 are in this respect each preloaded by means of a spring, not shown, in the direction of their respective blocking positions. The slide block 56 and the rotary slide block 58, however, satisfy different functions since they are effective as blocking elements at different times.

FIG. 7 shows the same cross-section plane as FIG. 4, but with a key 24 which has been introduced, but not yet rotated, that is in the so-called initial position. As FIG. 7 shows, the slide block 56 is actuated by the key tip 60 by introducing the key 24 into the keyway 28 (cf. FIG. 1) such that the slide block 56 is urged out of the slide block reception recess 68 in a direction transverse to the cylinder axis and is in so doing moved from the blocking position into a release position. A blocking of the disk housing 14 effected by the slide block 56 in the starting position in accordance with FIG. 4 and active with respect to the unlatching direction D is therefore canceled by introducing the key 24 into the keyway 28, with the slide block 56 being rotationally fixedly coupled via the attachment 62 with said disk housing.

As FIG. 7 likewise shows, the rotary slide block 58 is not yet actuated by the key tip 60 solely by introducing the key 24 into the keyway 28 (cf. FIG. 1). In the initial position with an introduced key 24, the rotary slide block 58 is therefore still in the blocking position and therefore engages into the rotary slide block reception recess 66 of the cylinder housing 12.

FIG. 5 shows in the starting position a cross-section through the lock cylinder 100 of FIG. 1 at the level of the front lift disk 48. As FIG. 5 shows, the control element 54 is arranged in a slit provided in the disk housing 14 and engages in the starting position into the control cut-out 70 of the front lift disk 48. The control element 54 thereby fixes the disk housing 14 and the front lift disk 48 toward one another.

As FIG. 5 also shows, the core pin 46 is likewise arranged in a slit of the disk housing 14 and engages into a fixing cut-out 72 which is formed at the outer periphery of the front lift disk 48. The core pin 46 thus likewise fixes the front lift disk 48 with respect to the disk housing 14. As FIG. 5 shows, a plurality of fixing cut-outs 72 are provided at the outer periphery of the front lift disk 48 which lie next to one another, viewed in the peripheral direction of the front lift disk 48, and which can also serve as chatter marks on the rotation of the front lift disk 48 relative to the core pin 46.

FIG. 8 shows the same cross-sectional plane as FIG. 5, but in the initial position with a key 24 which has been inserted and not yet rotated. As a comparison of FIGS. 5 and 8 shows, no change in the shown cross-sectional plane is yet effected by the introduction of the key 24 into the lock cylinder.

FIG. 6 shows a cross-section through the lock cylinder of FIG. 1 at the level of the rear lift disk 50 in the starting position. The core pin 46 likewise engages into a fixing cut-out 72 of the rear lift disk 50 in the starting position, wherein—as with the front lift disk 48—a plurality of fixing cut-outs 72 are likewise formed at the outer periphery of the rear lift disk 50 and are disposed next to one another in the peripheral direction. In a corresponding manner as is shown in FIGS. 5 and 6 for the front lift disk 48 and the rear lift disk 50, the core pin 46 also engages into corresponding fixing cut-outs 44 (cf. FIG. 1) which are each (cf. the fixing cut-outs 44 in FIG. 26) provided in the disk tumblers 16 (and preferably also in the intermediate disks 36) such that the core pin 46 also fixes the disk tumblers 16 against a rotation relative to the disk housing 14 in the starting position. The disk tumblers 16 can thus not be rotated individually with respect to the disk housing 14 in the starting position, whereby an effective protection against picking can already be achieved. In addition, an unintentional rotation of the disk tumblers 16 and of the lift disks 48, 50 can be prevented, whereby it can be ensured that the key 24 can be introduced into the keyway 28.

As FIG. 6 also shows, the blocking pin 22 (arranged in axial alignment with the control element 54 in accordance with FIG. 5) is arranged in a slit of the disk housing 14 and engages in the starting position into a blocking pin reception recess 74 formed at the inner wall of the cylinder housing 12. The blocking pin 22 contacts the outer side of the rear lift disk 50 so that the blocking pin 22, in contrast to the core pin 46, does not fix the lift disk 50 at the disk housing 14.

FIG. 9 shows the same cross-sectional plane as FIG. 6, but in the initial position with a key which has now been inserted, but not yet rotated. As can be seen by the comparison between FIG. 6 and FIG. 9, no change in the shown cross-sectional plane is effected by the introduction of the key.

FIG. 10 shows the same cross-sectional plane as FIGS. 4 and 7 while the key 24 is rotated into a so-called zero position and FIG. 13 again shows the same cross-sectional plane while the key 24 is rotated into a so-called end sorting position. In a corresponding manner, FIG. 11 shows the same cross-sectional plane as FIGS. 5 and 8 in the zero position and FIG. 14 again shows the same cross-sectional plane as FIGS. 5, 8 and 11 in the end sorting position. FIG. 12 shows the same cross-sectional plane as FIGS. 6 and 9 in the zero position and FIG. 15 again shows the same cross-sectional plane as FIGS. 6, 9 and 12 in the end sorting position.

In the zero position, the key 24 is rotated so far along an unlatching direction D with respect to the initial position that the disk housing 14 is first blocked against a further rotational movement and now, however, the disk tumblers 16 are released for a rotational movement relative to the disk housing 14 (so-called sorting). In the end sorting position, the sorting procedure of the disk tumblers 16 is completed so that the blocking cut-outs 20 of all the disk tumblers 16 are oriented in alignment with one another. In addition, in the end sorting position, the fixing cut-outs 44 of all the disk tumblers 16 are oriented in alignment with one another, viewed in the direction of the cylinder axis.

As FIGS. 10 and 13 furthermore show, the blocking element formed by the rotary slide block 58 first effects the blocking of the disk housing 14 in the zero position in order to fix the disk housing 14 relative to the cylinder housing 12 during the sorting of the disk tumblers 16. The rotary slide block 58 is only moved out of the blocking position into the release position on the reaching of the end sorting position, wherein the rotary slide block 58 is transposed radially inwardly in a translatory manner. In the end sorting position in accordance with FIG. 13, the rotary slide block 58 is thus out of engagement with the rotary slide block reception recess 66 of the cylinder housing 12. This transposition of the rotary slide block 58 into the release position which is delayed in time with respect to the transposition of the slide block 56 is effected by a rotational movement of the key 24.

The rotary slide block 58 has a driven flank 78 which does not yet come into contact with the tip 60 of the key 24 on the introduction of the key 24, that is in the initial position. A drive flank 80 (cf. FIGS. 2*a* and 2*b*) is formed at the key tip 60. The driven flank 78 of the rotary slide block 58 and the drive flank 80 at the tip 60 of the key 24 are adapted and cooperate such that the two flanks 78, 80 only come into contact with one another when the key 24 has been rotated in the unlatching direction D from the initial position (cf. FIG. 7) first into the zero position (cf. FIG. 10) and then up to just before the end sorting position. As soon as the two flanks 78, 80 have come into contact with one another, a slight further rotational movement of the key 24 which is transferred via the drive flank 80 onto the driven flank 78 and thus onto the rotary slide block 58 is sufficient so that the rotary slide block 58 guided in the attachment 62 is moved out of the rotary slide block reception recess 66 radially inwardly in a translatory manner into the release position. The lock cylinder 100 is now located in the end sorting position (cf. FIG. 13).

In this respect, the rotary slide block reception recess 66 at the inner wall of the cylinder housing 12 is larger, viewed in the peripheral direction or in the direction of rotation D, than the extent of the end of the rotary slide block 58 projecting into the rotary slide reception recess 66 in the peripheral direction. The rotary slide block 58 thus has a rotational clearance relative to the cylinder housing 12 in its blocking position. The rotational clearance is present starting from the starting position and the initial position in accordance with FIG. 4 or FIG. 7 in the unlatching direction D. After the introduction of the key 24, the rotational clearance thus first has to be overcome in that the key 24 and thus the disk housing 14 are rotated together with the rotary slide block 58 into the zero position in accordance with FIG. 10. Only then does a further rotation of the key 24 starting from the zero position into the end sorting position effect the movement of the rotary slide block 58 out of the blocking position into the release position. The rotary slide block 58 can therefore be co-rotated into the zero position on the rotation of the key in the unlatching direction D from the initial position which the key 24 adopts after the introduction into the lock cylinder 100 (cf. FIG. 1) such that the rotary slide block 58 first remains in the radially outer blocking position.

The rotary slide blocking reception recess 66, which is formed at the inner wall of the cylinder housing 12, has a first abutment surface 86 for the end of the rotary slide block 58 projecting into the rotary slide block reception recess 66. The end of the rotary slide block 58 comes into contact with the first abutment surface 86 when the key 24 is rotated in the unlatching direction D from the initial position in accordance with FIG. 7 into the zero position, as FIG. 10 shows. A further rotation of the disk housing 14 in the unlatching direction D can be blocked by the first abutment surface 86, in particular when an attempt is made to actuate the lock cylinder 100 with a non-matching "wrong" key via whose key tip the rotary slide block 58 cannot be actuated on the rotation of the key from the zero position into the end sorting position and in so doing can be brought out of engagement with the rotary slide block reception recess 66.

The rotary slide block reception recess 66 of the cylinder housing 12 additionally has a second abutment surface 88 which is disposed opposite the first abutment surface 86 and which the end of the rotary slide block 58 projecting into the rotary slide block reception recess 66 contacts with a removed key (cf. FIGS. 4 and 7). A rotation of the rotary slide block 58 and thus of the disk housing 14 against the unlatching direction D beyond the starting position is blocked by the second abutment surface 88. The starting position is thus in particular defined against the unlatching direction D by the abutment of the rotary slide block 58 at the second abutment surface 88 of the cylinder housing 12 and in the unlatching direction D by the abutment of the slide block 56 at a third abutment surface 90 of the cylinder housing 12 which bounds the slide block reception recess 68 in the unlatching direction D.

The particular configuration of the key tip 60 will be explained in even more detail in the following in connection with the actuation of the rotary slide block 58.

As mentioned, the key 24 has the tip 60 at its shaft 81 for actuating the rotary slide block 58, said tip cooperating with the rotary slide block 58 on the rotation of the key 24. As FIG. 2*a* shows, the shaft 81 in this respect has two broad sides 84 and two narrow sides 82 and the key tip or shaft tip 60 accordingly has two broad sides 84*a*, two narrow sides 82*a* and one end face 85.

Each broad side 84 of the shaft 81 has a plane 92 in which the outer surface of the respective broad side 84 lies. The plane 92 thus overlaps the outer elements or surfaces of the broad side 84 of the shaft 81. Recesses such as one or more elongate grooves in the broad side 84 are set back with respect to the plane 92 and thus toward the key axis. Only the plane 92 of the broad side 84 at the top in the illustration is shown in FIG. 2*a*.

A flattened portion 94 is provided at each broad side 84*a* of the shaft tip 60 relative to the respective plane 92 of the corresponding shaft broad side 84. The flattened portion 94 of the upper broad side 84*a* is in this respect formed with respect to the longitudinal key axis rotationally symmetrically by 180 degrees to the corresponding flattened portion at the lower broad side 84*a* of the key of FIG. 2*a* so that the key 24 can be used as a reversible key. The respective flattened portion 94 extends in the transverse direction, i.e. viewed transverse to the key axis, only over a part of the corresponding broad side 84*a* of the shaft tip 60 while another part of the corresponding broad side 84*a* of the shaft tip 60 forms said drive flank 80 for actuating the rotary slide block 58 and preferably lies in the plane 92 of the corresponding shaft broad side 84. The drive flank 80 comes into contact with the driven flank 78 of the rotary drive block 58 on the rotation of the key 24 from the zero position into the end sorting position, as explained above, to transpose the rotary slide block 58 into the release position (cf. FIG. 13). However, this requires that the driven flank 78 of the rotary slide block 58 reaches (in its blocking position) close enough to the axis of rotation of the introduced key 24 (which corresponds to the cylinder axis and to the longitudinal key axis). The respective flattened portion 94 at the shaft tip 60 in this respect makes it possible that the key 24 can nevertheless be introduced into the keyway 28 in the starting position of the lock cylinder 100 (FIG. 1) without the shaft tip 60 abutting the rotary slide block 58 reaching relatively closely to the cylinder axis and in particular abutting its driven flank 78. This can be seen in FIGS. 7 and 10 in which the flattened portion 94 of the shaft tip 60 is arranged directly adjacent to and in parallel with the section of the rotary slide block 58 having the driven flank 78. The explained delayed rotary actuation (relative to the actuation of the slide block 56) of the rotary slide block 58 is thus made possible with a sufficient stability of the shaft tip 60 within the boundaries (maximum cross-sectional extent of the shaft tip 60, i.e. maximum extent of the narrow sides 82*a* and of the broad sides 84*a*) predefined by the keyway 28. This rotary actuation takes place in that the drive flank 80 of the shaft tip 60 arranged eccentrically with respect to the cylinder axis carries out a tangential movement (i.e. is pivoted with a spacing about the cylinder axis).

The broad side 84*a* of the shaft tip 60 is set back with respect to the plane 92 of the broad side 84 of the shaft 81 in the region of the respective flattened portion 94. In the exemplary key 24 shown in FIGS. 2*a* and 2*b*, the flattened portion 94 extends in the longitudinal direction, i.e. viewed in the direction of the key axis, over the total broad side 84*a* of the shaft tip 60. The flattened portion 94 extends in the transverse direction, in contrast, over a part of the broad side 84*a* which takes up approximately 70% of the breadth of the broad side 84*a* of the shaft tip 60 while the drive flank 80 only extends over approximately 30% of the breadth of the broad side 84*a* in the transverse direction. The respective flattened portion 94 is—as shown in FIGS. 2*a* and 2*b*—obliquely inclined sectionally with respect to the plane 92 of the corresponding shaft broad side 84, wherein the oblique position angle is open between the respective flattened portion 94 and the plane 92 in a direction transverse to the longitudinal key axis (and is not, for instance, open along the longitudinal key axis). In other words, the respective flattened portion 94 is inclined relative to the corresponding shaft broad side 84 with respect to an axis which extends along or in parallel with the longitudinal key axis.

The flattened portion 94 can have a smooth surface so that no recesses (such as a bore) and/or elevated portions are formed thereon. Alternatively, however, at least one bore and/or at least one elevated portion can also be provided on the flattened portion 94 (not shown). The flattened portion 94 can in particular extend in parallel with or obliquely to or sectionally in parallel with and sectionally obliquely to the plane 92 of the corresponding shaft broad side 84. The flattened portion 94 can, for example, be inclined relative to the plane 92 of the shaft broad side 84 by an angle which can be in the range between 2 and 25 degrees. The flattened portion 94 can in particular also have an at least slightly curved contour, viewed transversely to the key axis. In the embodiment in accordance with FIG. 2*b*, the respective flattened portion 94 is concavely curved in a direction transverse to the key axis.

As can furthermore be seen in FIG. 2*a*, the narrow sides 82*a* of the shaft tip 60 extend toward the end face 85 toward one another like a roof. The narrow sides 82*a* thus extend in an oblique and tapering manner toward the end face 85.

In addition, the narrow sides 82*a* of the shaft tip 60 taper at the end of the shaft tip 60 remote from the end face 85 so that the tip 60 is set off from the remaining part of the shaft 81 by a peripheral notch 96 at the narrow sides 82*a*. The slide block 56 can latch into this notch 96 on the transition from the starting position (FIG. 4) into the initial position (FIG. 7). Viewed from the key tip 60, a further, second peripheral notch 98 can be formed behind the notch 96 at the narrow sides 92 of the shaft 91 into which a blocking disk 102 associated with the second notch 98 engages on the rotation of the key 24 (cf. FIG. 1). On a use of a non-matching key without a corresponding second notch 98, the blocking disk 102 can block a rotation of the key in the lock cylinder 100. The security against manipulation can thus be increased.

The further actuation of the lock cylinder 100 starting from the zero position will now be explained again in the following.

As FIG. 11 shows, the control element 54 moves out of engagement with the control cut-out 70 of the front lift disk 48 in the zero position in that the control element 54 is brought radially outwardly into engagement with a control element reception recess 104 which is formed at the inner side of the cylinder housing 12. The disk housing 14 is thereby fixed against a rotation at the cylinder housing 12, whereas the fixing of the front lift disk 48 at the disk housing 14 effected by the control element 54 is canceled.

As FIG. 11 furthermore shows, the core pin 46 is also urged radially outwardly out of the fixing cut-out 72 of the front lift disk 48 in the zero position so that the core pin 46 comes into engagement with a core pin reception recess 106 provided at the inner wall of the cylinder housing 12. A blocking of the rotation of the front lift disk 48 with respect to the disk housing 14 effected by the core pin 46 is thus canceled. In contrast, the core pin 46 fixes the disk housing 14 against a rotation at the cylinder housing 12 due to the engagement of the core pin 46 into the core pin reception recess 106.

As FIG. 12 shows, the core pin 46 also moves out of engagement with the corresponding fixing cut-out 72 and into engagement with the core pin reception recess 106 with respect to the rear lift disk 50, with said core pin reception recess extending e.g. in the form of an elongate groove over substantially the total length of the inner wall of the cylinder housing 12. The fixing of the rear lift disk 50 effected by the core pin 46 with respect to the disk housing 14 is canceled.

In a corresponding manner, the core pin 46 also moves out of engagement with the fixing cut-outs 44 of the disk tumblers 16 so that the blocking of the disk tumblers 16 with respect to the disk housing 14 in the zero position is canceled and the disk tumblers 16 are now released for a sorting. This sorting now takes place, as explained, by cooperation of the incisions 26 of the key 24 with the inner walls or boundaries of the reception openings 18 of the disk tumblers 16.

FIG. 13 shows the end sorting position after the rotary disk block 58 has been transposed into the release position, as explained, by a rotational movement of the key tip 60.

As FIG. 14 shows, the front lift disk 48 is rotated in the end sorting position such that the peripheral cut-out 108 provided at the outer periphery of the front lift disk 48 is oriented radially in alignment with the control element 54. In addition, the fixing cut-out 72 is oriented radially in alignment with the core pin 46.

The disk tumblers 16 are sorted in the end sorting position. The blocking cut-outs 20 of the disk tumblers 16 (cf. FIG. 1) and accordingly also the blocking cut-out 20 of the rear lift disk 50 are in particular oriented in alignment with one another, viewed in the direction of the cylinder axis, and are arranged radially inwardly with respect to the blocking pin 22. In addition, in the end sorting position, the fixing cut-outs 44 of the disk tumblers 16 are arranged radially inwardly with respect to the core pin 46 in a corresponding manner to the fixing cut-out 72 of the rear lift disk 50 in accordance with FIG. 15 and are oriented in alignment with one another, viewed in the direction of the cylinder axis.

FIGS. 16, 19 and 22 show the same cross-sectional plane as FIGS. 4, 7, 10 and 13. However, in FIG. 16 the key 24 is in a so-called unblocking position rotated further in the unlatching direction D with respect to the end sorting position of FIG. 13. In FIG. 19, the key 24 is in a so-called unblocked position and in FIG. 22 the key 24 is in the unlatched position.

FIGS. 17, 20 and 23 show the same cross-sectional plane as FIGS. 5, 8, 11 and 14. In this respect, FIG. 17 relates to the unblocking position, whereas FIG. 20 shows the unblocked position and FIG. 23 shows the unlatched position. Accordingly, FIGS. 18, 21 and 24 show the same cross-section plane as FIGS. 6, 9, 12, and 15. FIG. 18 in this respect shows the situation in the unblocking position, whereas FIG. 21 shows the unblocked position. FIG. 24 furthermore shows the situation in the unlatched position.

As can be seen by a comparison of FIGS. 14 and 17, on a further rotation of the key 24 in the unlatching direction D out of the end sorting position, both the control element 54 and the core pin 46 are urged radially inwardly. In this respect, the core pin 46 comes into engagement with the fixing cut-out 72 of the front lift disk 48 or of the rear lift disk 50 disposed within the core pin 46. The control element 54 furthermore comes into engagement with the peripheral cut-out 108 of the front lift disk 48 and out of engagement with the control element reception recess 104 formed in the cylinder housing 12. A fixing of the front lift disk 48 with the disk housing 14 takes place by the inward movement of the core pin 46 and of the control element 54.

As can in particular be seen in FIGS. 11, 14 and 17, the front lift disk 48 has an abutment 110 at the outer periphery which comes into contact with a counter-abutment 112 provided at the disk housing 14 on a reaching of the end sorting position in accordance with FIG. 14 (a corresponding abutment is also provided at the rear lift disk 50). By a further rotation of the front lift disk 48 coupled to the key 24 and of the rear lift disk 50 in the unlatching direction D out of the end sorting position in accordance with FIG. 14, the disk housing 14 is thus co-moved due to the interplay between the abutment 110 and the counter-abutment 112. In this respect, the disk housing 14 urges the core pin 46 toward a core pin guide chamfer 114 which bounds the core pin reception recess 106, viewed in the unlatching direction D, and by which the core pin 46 is urged at a precisely defined position of angular rotation into the fixing cut-outs 72 of the lift disks 48, 50 and into the fixing cut-outs 44 of the disk tumblers 16 (cf. FIGS. 17 and 18).

In a corresponding manner, on a rotation of the disk housing 14 out of the end sorting position, the disk housing 14 urges the control element 54 toward a control element guide chamfer 116 which bounds the control element reception recess 104, viewed in the unlatching direction D, and by which the control element 54 is urged radially inwardly into the peripheral cut-out 108 of the front lift disk 48 at a defined angular position (cf. FIG. 17). The angular position of the disk housing 14 can hereby be defined with a particularly high precision, in which angular position the disk housing 14 is decoupled from the cylinder housing 12 (for the subsequent unlatching) and coupled to the front lift disk 48 (and thus to the key 24).

As is shown with respect to FIG. 15, the blocking pin reception recess 74 of the cylinder housing 12 offers a larger rotational clearance (in particular in the unlatching direction D) in the end sorting position with respect to the core pin reception recess 106 and the control element reception recess 104 so that the blocking pin 22 is not yet first urged radially inwardly into the blocking cut-out 20 of the rear lift disk 50 and accordingly into the blocking cut-outs 20 of the disk tumblers 16 (cf. FIG. 18) on a further rotation of the disk housing 14 in the unlatching direction out of the end sorting position.

As FIGS. 18 and 21 show, the blocking pin 22 only moves into contact with a blocking pin guide chamfer 118 bounding the blocking pin reception recess 74 in the unlatching direction D on a reaching of the unblocking position. The blocking pin guide chamfer 118 urges the blocking pin 22 radially inwardly on the further rotation of the disk housing 14 from the unblocking position into the unblocked position in accordance with FIG. 24 so that the blocking pin 22 moves into engagement with the blocking cut-outs 20 of the rear lift disk 50 and of the disk tumblers 16. The key 24 can then be further rotated together with the disk housing 14 and the disks 16, 48, 50 into the unlatched position in accordance with FIGS. 22, 23 and 24 in order, as explained, to actuate a lock mechanism by means of the attachment 62.

It can thus be simply achieved with the lock cylinder 100 in accordance with the above explanations that, on the rotation of the disk housing 14 by means of the key 24 out of the end sorting position and in the unlatching direction D, the core pin 46 first moves into the fixing cut-outs 72 of the lift disks 48, 50 and into the fixing cut-outs 44 of the disk tumblers 16 (cf. FIG. 1) and hereby fixes the disk tumblers 16 relative to one another and to the disk housing 14 and that (due to an even further rotation of the disk housing 14) the blocking pin 22 only then engages into the blocking cut-outs 20 to release the disk housing 14 for a further rotation into the unlatching position. Due to the explained different rotational clearance or to the explained defined time sequence, the blocking pin 22 can therefore not be urged radially inwardly with the aid of the blocking pin guide chamfer 118 at a time at which the disk tumblers 16 can still be separately rotated (e.g. by means of a picking tool). A probing of the respective encoding of the individual disk tumblers 16 is therefore hereby prevented.

For the latching, the rotation of the key 24 takes place, starting from the unlatched position in accordance with FIGS. 22, 23 and 24, against the direction of rotation D up to the initial position. The procedure and the cooperation of the individual elements of the lock cylinder 100 can be seen from the above description.

The front lift disk 48 has at its outer periphery a second abutment 120 which comes into contact with a second counter-abutment 122 provided at the disk housing 14 (cf. FIG. 11) on the rotating back of the front lift disk 48 from the end sorting position (cf. FIG. 14) against the unlatching direction D, that is in the latching direction, on reaching the zero position. A corresponding abutment is also provided at the rear lift disk 50. The disk housing 14 can be co-rotated due to the interplay between the second abutment 120 and the second counter-abutment 122 by a rotation of the lift disks 48, 50 back out of the zero position in the latching direction to urge the control element 54 and the core pin 46 radially inwardly (cf. in particular FIGS. 8 and 11).

REFERENCE NUMERAL LIST

10, 100 lock cylinder
12 cylinder housing
14 disk housing
16 disk tumbler
18 reception opening
20 blocking cut-out
22 blocking pin
24 key
26 incision
32 slit
34 blocking pin reception recess
36 intermediate disk
38, 38*a* peripheral cut-out
40 abutment section
42 projection
44 fixing cut-out
46 core pin
48 front lift disk
50 rear lift disk
52 cover
54 control element
56 slide block
58 rotary slide block
60 key tip
62 attachment
64 clamp
66 rotary slide block reception recess
68 slide block reception recess
70 control cut-out
72 fixing cut-out
74 blocking pin reception recess
78 driven flank
80 drive flank
81 shaft
82, 82*a* narrow side
84, 84*a* broad side
85 end face
86 first abutment surface
88 second abutment surface
90 third abutment surface
92 plane
94 flattened portion
96 notch

98 second notch
102 blocking disk
104 control element reception recess
106 core pin reception recess
108 peripheral cut-out
110 abutment
112 counter-abutment
114 core pin guide chamfer
116 control element guide chamfer
118 blocking pin guide chamfer
120 second abutment
122 second counter-abutment
A introduction direction
D unlatching direction

The invention claimed is:

1. A lock cylinder comprising
a cylinder housing,
a disk housing rotatably supported about a cylinder axis in the cylinder housing;
a plurality of rotatably supported disk tumblers arranged along the cylinder axis in the disk housing,
wherein each disk tumbler has a reception opening for a key, a blocking cut-out at the outer periphery for an at least partial reception of a blocking pin aligned in parallel with the cylinder axis and, offset from the blocking cut-out, a fixing cut-out provided at the outer periphery for an at least partial reception of a core pin aligned in parallel with the cylinder axis; and
wherein the disk tumblers are rotatable from a starting position with a removed key by a rotation of the introduced key in an unlatching direction (D) into an end sorting position in which the blocking cut-outs of all the disk tumblers are oriented in alignment with one another, viewed in the direction of the cylinder axis; and
wherein the fixing cut-outs of all the disk tumblers are oriented in alignment with one another in the direction of the cylinder axis in the end sorting position, with the lock cylinder being adapted such that, on a further rotation of the disk tumblers out of the end sorting position in the unlatching direction (D), the core pin first engages into the fixing cut-outs and the blocking pin only then engages into the blocking cut-outs, wherein the core pin engages into a core pin reception recess of the cylinder housing in the end sorting position and the lock cylinder is adapted such that the core pin is urged radially inwardly into the fixing cut-outs by a rotation of the key out of the end sorting position in the unlatching direction (D), wherein the blocking pin engages into a blocking pin reception recess of the cylinder housing in the end sorting position and the lock cylinder is adapted such that, once the core pin has been urged into the fixing cut-outs, the blocking pin is urged radially inwardly into the blocking cut-outs by a further rotation of the key in the unlatching direction (D), wherein the core pin reception recess of the cylinder housing into which the core pin engages in the end sorting position extends over a smaller peripheral angle than the blocking pin reception recess of the cylinder housing into which the blocking pin engages in the end sorting position.

2. A lock cylinder comprising:
a cylinder housing,
a disk housing rotatably supported about a cylinder axis in the cylinder housing;
a plurality of rotatably supported disk tumblers arranged along the cylinder axis in the disk housing,
wherein each disk tumbler has a reception opening for a key, a blocking cut-out at the outer periphery for an at least partial reception of a blocking pin aligned in parallel with the cylinder axis and, offset from the blocking cut-out, a fixing cut-out provided at the outer periphery for an at least partial reception of a core pin aligned in parallel with the cylinder axis; and
wherein the disk tumblers are rotatable from a starting position with a removed key by a rotation of the introduced key in an unlatching direction (D) into an end sorting position in which the blocking cut-outs of all the disk tumblers are oriented in alignment with one another, viewed in the direction of the cylinder axis; and
wherein the fixing cut-outs of all the disk tumblers are oriented in alignment with one another in the direction of the cylinder axis in the end sorting position, with the lock cylinder being adapted such that, on a further rotation of the disk tumblers out of the end sorting position in the unlatching direction (D), the core pin first engages into the fixing cut-outs and the blocking pin only then engages into the blocking cut-outs,
wherein the core pin engages into a core pin reception recess of the cylinder housing in the end sorting position and the lock cylinder is adapted such that the core pin is urged radially inwardly into the fixing cut-outs by a rotation of the key out of the end sorting position in the unlatching direction (D), wherein the blocking pin engages into a blocking pin reception recess of the cylinder housing in the end sorting position and the lock cylinder is adapted such that, once the core pin has been urged into the fixing cut-outs, the blocking pin is urged radially inwardly into the blocking cut-outs by a further rotation of the key in the unlatching direction (D), wherein the core pin reception recess of the cylinder housing is bounded by a core pin guide chamfer in the unlatching direction (D) and the blocking pin reception recess of the cylinder housing is bounded by a blocking pin guide chamfer in the unlatching direction (D), with the angular spacing between the core pin and the core pin guide chamfer being smaller in the end sorting position than the angular spacing between the blocking pin and the blocking pin guide chamfer.

3. A lock cylinder in accordance with claim 2,
wherein the core pin fixes the disk housing against a rotation at the cylinder housing when the core pin engages into the core pin reception recess of the cylinder housing in the end sorting position.

4. A lock cylinder comprising
a cylinder housing;
a disk housing rotatably supported about a cylinder axis in the cylinder housing;
a plurality of rotatably supported disk tumblers arranged along the cylinder axis in the disk housing,
wherein each disk tumbler has a reception opening for a key, a blocking cut-out at the outer periphery for an at least partial reception of a blocking pin aligned in parallel with the cylinder axis and, offset from the blocking cut-out, a fixing cut-out provided at the outer periphery for an at least partial reception of a core pin aligned in parallel with the cylinder axis; and
wherein the disk tumblers are rotatable from a starting position with a removed key by a rotation of the introduced key in an unlatching direction (D) into an end sorting position in which the blocking cut-outs of all the disk tumblers are oriented in alignment with one another, viewed in the direction of the cylinder axis; and
wherein the fixing cut-outs of all the disk tumblers are oriented in alignment with one another in the direction of the cylinder axis in the end sorting position, with the lock cylinder being adapted such that, on a further rotation of the disk tumblers out of the end sorting position in the unlatching direction (D), the core pin first engages into the fixing cut-outs and the blocking pin only then engages into the blocking cut-outs, wherein the lock cylinder has a control element or blocking element which is separate from the blocking pin and which fixes the disk housing against a rotation in the unlatching direction (D) at the cylinder housing during the rotation of the disk tumblers into the end sorting position.

5. A lock cylinder in accordance with claim 4, wherein the blocking element is arranged in front of the disk tumblers, with respect to a key introduction direction (A), and is rotationally fixedly coupled to the disk housing, with the blocking element being movable by a rotation of the key in an unlatching direction (D) out of a blocking position in which the blocking element engages into a reception recess of the cylinder housing into a release position in which the blocking element is out of engagement with the reception recess.

6. A lock cylinder comprising a cylinder housing;

a disk housing rotatably supported about a cylinder axis in the cylinder housing;

a plurality of rotatably supported disk tumblers arranged along the cylinder axis in the disk housing, wherein each disk tumbler has a reception opening for a key, a blocking cut-out at the outer periphery for an at least partial reception of a blocking pin aligned in parallel with the cylinder axis and, offset from the blocking cut-out, a fixing cut-out provided at the outer periphery for an at least partial reception of a core pin aligned in parallel with the cylinder axis; and wherein the disk tumblers are rotatable from a starting position with a removed key by a rotation of the introduced key in an unlatching direction (D) into an end sorting position in which the blocking cut-outs of all the disk tumblers are oriented in alignment with one another, viewed in the direction of the cylinder axis; and wherein the fixing cut-outs of all the disk tumblers are oriented in alignment with one another in the direction of the cylinder axis in the end sorting position, with the lock cylinder being adapted such that, on a further rotation of the disk tumblers out of the end sorting position in the unlatching direction (D), the core pin first engages into the fixing cut-outs and the blocking pin only then engages into the blocking cut-outs, wherein at least one lift disk is provided which is arranged in parallel with the disk tumblers and which is rotatably supported in the disk housing and which has a reception opening for the key, with the lift disk being compulsorily guided with the introduced key with respect to a rotation of the key, and with a control element being associated with the lift disk and being supported in a slit of the disk housing.

7. A lock cylinder in accordance with claim 6, wherein the lift disk has at least one fixing cut-out provided at its outer periphery for an at least partial reception of the core pin.

8. A lock cylinder in accordance with claim 6, wherein the lift disk has a control cut-out at its outer periphery for an at least partial reception of the control element.

9. A lock cylinder in accordance with claim 8, wherein the control element engages into the control cut-out in the starting position with a removed key.

10. A lock cylinder in accordance with claim 8, wherein the disk housing and the lift disk are rotatable from an initial position with a key which has been introduced and not yet rotated in the unlatching direction (D) into a zero position, and wherein the lock cylinder is adapted such that in the zero position the control element is urged radially outwardly into a control element reception recess of the cylinder housing and is brought out of engagement with the control cut-out of the lift disk.

11. A lock cylinder in accordance with claim 10, wherein the lift disk is rotatable from the zero position up to the end sorting position relative to the disk housing, while the disk housing is fixed at the cylinder housing by engagement of the control element into the control element reception recess.

12. A lock cylinder in accordance with claim 6, wherein the lift disk has a peripheral cut-out at its outer periphery for an at least partial reception of the control element, with the control element engaging into a control element reception recess of the cylinder housing in the end sorting position, and with the peripheral cut-out of the lift disk being aligned in a radial direction with the control element in the end sorting position.

13. A lock cylinder in accordance with claim 12, wherein the lock cylinder is adapted such that the control element is urged radially inwardly out of the control element reception recess by a rotation of the lift disk out of the end sorting position in the unlatching direction (D) and in so doing engages into the peripheral cut-out of the lift disk.

14. A lock cylinder in accordance with claim 12, wherein, viewed in the unlatching direction (D), the control element reception recess of the cylinder housing extends over a peripheral angle which is smaller than or at most as large as the peripheral angle of a core pin reception recess or of said core pin reception recess of the cylinder housing into which the core pin engages in the end sorting position.

15. A lock cylinder in accordance with claim 6, wherein the lift disk has an abutment at the outer periphery which comes into contact with a counter-abutment provided at the disk housing on a rotation of the lift disk form the starting position in the unlatching direction (D) on reaching the end sorting position.

16. A lock cylinder in accordance with claim 6, wherein the lift disk has a further abutment at the outer periphery which comes into contact with a further counter-abutment provided at the disk housing on a rotation of the lift disk back from the end sorting position in the latching direction.

17. A lock cylinder in accordance with claim 4, wherein the control element is offset along the cylinder axis with respect to the blocking pin, but is arranged at the same angular position.

18. A lock cylinder in accordance with claim 1, wherein the core pin fixes the disk housing against a rotation at the cylinder housing when the core pin engages into the core pin reception recess of the cylinder housing in the end sorting position.

* * * * *